US011832710B2

(12) United States Patent
Lotti

(10) Patent No.: US 11,832,710 B2
(45) Date of Patent: Dec. 5, 2023

(54) STORAGE CASE FOR ARTIFICIAL LASH EXTENSIONS

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 13 days.

(21) Appl. No.: 17/669,281

(22) Filed: Feb. 10, 2022

(65) Prior Publication Data

US 2022/0160110 A1 May 26, 2022

Related U.S. Application Data

(60) Continuation of application No. 16/867,391, filed on May 5, 2020, now Pat. No. 11,278,102, which is a division of application No. 15/968,453, filed on May 1, 2018, now Pat. No. 10,638,826, which is a continuation of application No. PCT/US2017/067513, filed on Dec. 20, 2017.

(Continued)

(51) Int. Cl.

| | |
|---|---|
| ***A45D 44/00*** | (2006.01) |
| ***A41G 5/02*** | (2006.01) |
| ***B25B 9/02*** | (2006.01) |

(52) U.S. Cl.

CPC ..... *A45D 44/00* (2013.01); *A41G 5/02* (2013.01); *B25B 9/02* (2013.01); *A45D 2200/05* (2013.01); *A45D 2200/10* (2013.01)

(58) Field of Classification Search

CPC ..... A41G 5/02; A45C 11/008; A45D 44/00; A45D 2200/05

See application file for complete search history.

(56) References Cited

U.S. PATENT DOCUMENTS

| | | | |
|---|---|---|---|
| 1,021,063 | A | 3/1912 | Miller |
| 1,450,259 | A | 4/1923 | Nessler |

(Continued)

FOREIGN PATENT DOCUMENTS

| | | | |
|---|---|---|---|
| CN | 102975141 | A | 3/2013 |
| CN | 103027410 | A | 4/2013 |

(Continued)

OTHER PUBLICATIONS

United States District Court District of New Jersey, 2:20-cv-10023-JMV-MF, *Lashify, Inc.* v. *Kiss Nail Products, Inc.*

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

A storage case for holding artificial lash extensions includes a storage base. The storage base includes a first outer sidewall having first curved surface, and a first plurality of indentations extending inward from the first curved surface of the first outer sidewall. Each indentation of the first plurality of indentations is substantially flat and extends inward from the first curved surface. Each indentation of the first plurality of indentations is designed to house an artificial lash extension of the artificial lash extensions.

20 Claims, 13 Drawing Sheets

Related U.S. Application Data

(60) Provisional application No. 62/436,585, filed on Dec. 20, 2016.

(56) References Cited

U.S. PATENT DOCUMENTS

| | | | | |
|---|---|---|---|---|
| 1,831,801 | A | | 11/1931 | Birk |
| 1,897,747 | A | | 2/1933 | Birk |
| 1,920,401 | A | | 8/1933 | Kahn |
| 2,013,011 | A | | 9/1935 | Sheldon |
| D101,791 | S | | 11/1936 | Rauh |
| D129,526 | S | | 9/1941 | Hanisch |
| 2,268,082 | A | | 12/1941 | Phillips, Sr. |
| 2,323,595 | A | | 7/1943 | Hanisch |
| 2,392,694 | A | | 1/1946 | Rector |
| D154,227 | S | | 6/1949 | Alvizua |
| D155,559 | S | | 10/1949 | Tillmann |
| 2,618,279 | A | | 11/1952 | Reiffert |
| 2,812,768 | A | | 11/1957 | Giuliano |
| 3,016,059 | A | | 1/1962 | Hutton |
| 3,032,042 | A | | 5/1962 | Meehan |
| 3,032,342 | A | | 5/1962 | Glass |
| 3,174,321 | A | | 3/1965 | Williams |
| 3,245,416 | A | | 4/1966 | Aylott |
| 3,295,534 | A | | 1/1967 | Dorkin |
| 3,343,552 | A | | 9/1967 | Steffen |
| 3,392,727 | A | | 7/1968 | Hanlon |
| 3,447,540 | A | | 6/1969 | Osher |
| 3,454,015 | A | | 7/1969 | Udes |
| 3,478,754 | A | | 11/1969 | Martin, Jr. |
| 3,547,135 | A | | 12/1970 | Roos |
| 3,557,653 | A | | 1/1971 | Kim |
| 3,561,454 | A | | 2/1971 | Oconnell |
| 3,625,229 | A | * | 12/1971 | Silson ..... A41G 5/02 132/216 |
| 3,645,281 | A | | 2/1972 | Seidler |
| 3,670,742 | A | | 6/1972 | Weaner |
| 3,703,180 | A | | 11/1972 | Aylott |
| 3,828,803 | A | | 8/1974 | Windsor |
| 3,833,007 | A | | 9/1974 | Jacobs |
| 3,900,038 | A | | 8/1975 | Masters |
| D240,769 | S | | 7/1976 | Bowman |
| 3,968,807 | A | | 7/1976 | Kraicer |
| 3,970,092 | A | | 7/1976 | Nelson |
| 3,970,992 | A | | 7/1976 | Boothroyd et al. |
| 3,971,392 | A | | 7/1976 | Brehmer |
| 3,980,092 | A | | 9/1976 | Garufi |
| 3,982,313 | A | | 9/1976 | Nelson, Jr. |
| 4,016,889 | A | | 4/1977 | Cowles |
| 4,029,111 | A | | 6/1977 | Barton |
| 4,049,006 | A | | 9/1977 | Saunders et al. |
| 4,163,535 | A | | 8/1979 | Austin |
| 4,168,713 | A | | 9/1979 | Agiotis |
| 4,203,518 | A | | 5/1980 | Current |
| 4,205,693 | A | | 6/1980 | Mallouf |
| 4,225,693 | A | | 9/1980 | McCormick |
| 4,254,772 | A | | 3/1981 | McNamee |
| 4,254,784 | A | | 3/1981 | Nelson |
| 4,284,092 | A | | 8/1981 | Auretta |
| 4,296,765 | A | | 10/1981 | Bachtell |
| D261,601 | S | | 11/1981 | Kettlestrings |
| 4,299,242 | A | | 11/1981 | Choe |
| 4,360,033 | A | | 11/1982 | Schmehling |
| 4,395,824 | A | | 8/1983 | Puro |
| D270,551 | S | | 9/1983 | Thayer |
| 4,458,701 | A | | 7/1984 | Holland |
| 4,509,539 | A | | 4/1985 | Alfieri |
| D280,354 | S | | 8/1985 | Bakic |
| D281,259 | S | | 11/1985 | Hensley |
| D281,825 | S | | 12/1985 | Bakic |
| 4,600,029 | A | | 7/1986 | Ueberschaar |
| 4,697,856 | A | | 10/1987 | Abraham |
| 4,739,777 | A | | 4/1988 | Nelson |
| D298,070 | S | | 10/1988 | Ferrari |
| 4,784,713 | A | | 11/1988 | Van Nieulande |
| D299,561 | S | | 1/1989 | Bakic |
| D301,371 | S | | 5/1989 | Kaprelian |
| D302,602 | S | | 8/1989 | Bakic |
| 4,865,057 | A | | 9/1989 | Braun |
| 4,934,387 | A | | 6/1990 | Megna |
| 4,964,428 | A | | 10/1990 | Amatrice |
| D314,066 | S | | 1/1991 | Bakic |
| 5,010,914 | A | | 4/1991 | Merges |
| D318,346 | S | | 7/1991 | Bakic |
| 5,033,626 | A | | 7/1991 | Platti |
| 5,072,745 | A | | 12/1991 | Cheh |
| 5,082,010 | A | | 1/1992 | Skaryd et al. |
| 5,117,846 | A | | 6/1992 | Finamore et al. |
| D328,246 | S | | 7/1992 | Nottingham et al. |
| 5,154,195 | A | | 10/1992 | Irisawa |
| D342,671 | S | | 12/1993 | Elliott |
| D343,340 | S | | 1/1994 | Frye, Jr. et al. |
| 5,307,826 | A | | 5/1994 | Iosilevich |
| D348,219 | S | | 6/1994 | Goldberg |
| 5,322,166 | A | | 6/1994 | Crowther |
| 5,368,052 | A | | 11/1994 | Finamore |
| 5,377,700 | A | | 1/1995 | Harris |
| D358,312 | S | | 5/1995 | Keenan |
| D358,908 | S | | 5/1995 | Rawski |
| 5,411,775 | A | | 5/1995 | Wilson |
| 5,419,345 | A | | 5/1995 | Kadymir |
| D359,583 | S | | 6/1995 | Abbo |
| D368,495 | S | | 4/1996 | Rypinski |
| 5,533,529 | A | | 7/1996 | Ohno |
| 5,547,529 | A | | 8/1996 | Woolf |
| D373,726 | S | * | 9/1996 | Power ..... D9/429 |
| 5,571,543 | A | | 11/1996 | Song et al. |
| D379,923 | S | | 6/1997 | De Baschmakoff |
| D380,616 | S | | 7/1997 | Leslie et al. |
| D382,198 | S | | 8/1997 | Mulhauser et al. |
| D386,808 | S | | 11/1997 | Litton |
| D387,483 | S | | 12/1997 | Sloan |
| D388,549 | S | | 12/1997 | Mouyiaris et al. |
| 5,746,232 | A | | 5/1998 | Martin et al. |
| 5,765,571 | A | | 6/1998 | Dinnel |
| D397,040 | S | | 8/1998 | Bakic |
| 5,813,418 | A | | 9/1998 | Pillars |
| D403,922 | S | | 1/1999 | Terracciano et al. |
| D404,531 | S | | 1/1999 | Bakic et al. |
| 5,894,846 | A | | 4/1999 | Gang |
| 5,896,996 | A | | 4/1999 | Chuang |
| D411,649 | S | | 6/1999 | Bakic |
| D418,018 | S | | 12/1999 | Winsted |
| D418,253 | S | | 12/1999 | Bakic |
| 6,003,467 | A | | 12/1999 | Shelton-Ferrell et al. |
| 6,016,814 | A | | 1/2000 | Elliott |
| 6,019,107 | A | | 2/2000 | Overmyer et al. |
| 6,029,674 | A | | 2/2000 | Han |
| 6,032,609 | A | | 3/2000 | Luoma |
| 6,035,861 | A | | 3/2000 | Copello |
| 6,092,291 | A | | 7/2000 | Cendoma |
| 6,109,274 | A | | 8/2000 | Ingersoll |
| D437,086 | S | | 1/2001 | Dickert |
| 6,174,321 | B1 | | 1/2001 | Webb |
| 6,182,839 | B1 | | 2/2001 | Robbins et al. |
| D442,304 | S | | 5/2001 | Huang |
| 6,230,715 | B1 | | 5/2001 | Cho |
| D443,471 | S | | 6/2001 | Lillelund et al. |
| 6,247,476 | B1 | | 6/2001 | Sartena |
| 6,257,250 | B1 | | 7/2001 | Sartena |
| 6,265,010 | B1 | | 7/2001 | Franco |
| D448,927 | S | | 10/2001 | Vazquez |
| 6,302,115 | B1 | | 10/2001 | Sartena |
| 6,308,716 | B1 | | 10/2001 | Han |
| D452,151 | S | | 12/2001 | Scott |
| D454,981 | S | | 3/2002 | Lamagna et al. |
| D456,077 | S | | 4/2002 | Etter et al. |
| D456,097 | S | | 4/2002 | LaMagna et al. |
| D458,413 | S | | 6/2002 | Boilen |
| 6,405,736 | B2 | | 6/2002 | Townsend |
| 6,439,406 | B1 | | 8/2002 | Duhon |
| D463,280 | S | | 9/2002 | Brozell |
| D463,744 | S | | 10/2002 | Brozell |
| D464,565 | S | | 10/2002 | Weinstein et al. |

(56) References Cited

U.S. PATENT DOCUMENTS

D464,877 S 10/2002 Weinstein et al.
6,471,515 B2 10/2002 Feuer
D467,800 S 12/2002 Chen et al.
6,494,212 B1 12/2002 Yamakoshi
6,530,379 B2 3/2003 Iosilevich
D472,675 S 4/2003 Lamagna
D472,810 S 4/2003 Gelardi et al.
D473,106 S 4/2003 Scherer
6,561,197 B2 5/2003 Harrison
6,567,640 B2 5/2003 Ishikawa
D475,616 S 6/2003 Lambrecht
6,581,609 B2 6/2003 Ott
D479,365 S 9/2003 Todeschini
D480,864 S 10/2003 Sayers et al.
D481,946 S 11/2003 Nicholson et al.
D481,952 S 11/2003 Orsomando
D482,495 S 11/2003 Jackel-Marken
D482,928 S 12/2003 Liu
D482,934 S 12/2003 Liu
D483,232 S 12/2003 Liu
D483,633 S 12/2003 Jansson et al.
D483,909 S 12/2003 Todeschini
D485,359 S 1/2004 McMichael et al.
6,688,315 B1 2/2004 Harrison
6,691,714 B1 2/2004 Yaguchi et al.
6,708,696 B2 3/2004 Ferguson
D488,353 S 4/2004 Govrik et al.
D488,618 S 4/2004 Wekstein
D490,932 S 6/2004 Mammone
D491,336 S 6/2004 Cecere
D495,834 S 9/2004 Todeschini
D496,759 S 9/2004 Rodriguez
6,820,625 B2 11/2004 Park
D501,580 S 2/2005 Sugawara
D506,573 S 6/2005 de Grandcourt
D507,678 S 7/2005 Lamagna
6,935,348 B2 8/2005 Gold
6,935,349 B2 8/2005 Nicot et al.
D509,942 S 9/2005 Connolly et al.
D512,913 S 12/2005 Gauthier
6,973,931 B1 12/2005 King
6,981,814 B2 1/2006 Geardino et al.
D515,242 S 2/2006 Cho
D516,247 S 2/2006 Merheje
7,000,775 B2 2/2006 Gelardi et al.
7,036,518 B2 5/2006 Park
D522,376 S 6/2006 Hales
D532,891 S 11/2006 Buthier et al.
D533,650 S 12/2006 Ohta
D534,426 S 1/2007 Bakic
7,159,720 B2 1/2007 Pearson
7,168,432 B1 1/2007 Brumfield
D537,208 S 2/2007 Shaljian
D540,112 S 4/2007 Nichols et al.
D543,662 S 5/2007 Bivona et al.
D543,815 S 6/2007 Metcalf
D543,850 S 6/2007 Legros
D544,148 S 6/2007 Bivona et al.
D544,202 S 6/2007 Markfelder
D545,396 S 6/2007 Casey et al.
7,228,863 B2 6/2007 Dumler et al.
D546,002 S 7/2007 Bowen
D547,940 S 8/2007 Sandy
D559,457 S 1/2008 Garland et al.
D561,045 S 2/2008 Lee
D561,942 S 2/2008 Khubani
7,331,351 B1 2/2008 Asai
D563,157 S 3/2008 Bouveret et al.
D563,616 S 3/2008 Lynde et al.
D563,728 S 3/2008 Welch, III
7,343,921 B2 3/2008 Salinas
D569,041 S 5/2008 Azoulay
D569,553 S 5/2008 Cho
7,374,048 B2 5/2008 Mazurek
D571,543 S 6/2008 Sungadi
D573,308 S 7/2008 Wittke-Kothe
D575,904 S 8/2008 Iqbal
D579,059 S 10/2008 Chan
7,469,701 B1 12/2008 Bernard
D584,449 S 1/2009 Shaljian
D587,529 S 3/2009 Pratt
D588,746 S 3/2009 Ross
D591,599 S 5/2009 Okin et al.
D592,923 S 5/2009 Konopka
7,533,676 B2 5/2009 Sthair
D595,054 S 6/2009 Whitaker
7,543,718 B2 6/2009 Simon
D600,441 S 9/2009 Estrada
D602,354 S 10/2009 Dibnah et al.
7,600,519 B2 10/2009 Dinh
D604,579 S 11/2009 Robinson et al.
7,610,921 B2 11/2009 Gold
D605,514 S 12/2009 Weber
D607,332 S 1/2010 Huntington et al.
D615,290 S 5/2010 Heffner
D617,187 S 6/2010 Murray
D617,943 S 6/2010 Bouix et al.
D618,078 S 6/2010 Cripps et al.
7,748,391 B2 7/2010 Vance
D627,103 S 11/2010 Cho
7,836,899 B2 11/2010 Sugai et al.
D631,606 S 1/2011 Chen
7,896,192 B2 3/2011 Conley et al.
D638,733 S 5/2011 Sullivan et al.
7,938,128 B2 5/2011 Gueret
D639,196 S 6/2011 Sullivan et al.
D640,005 S 6/2011 Lee et al.
D640,834 S 6/2011 Chen
D641,106 S 7/2011 Williams et al.
8,015,980 B2 9/2011 Rabe et al.
8,025,065 B2 9/2011 Guliker
8,042,553 B2 10/2011 Paris
D647,799 S 11/2011 Dunwoody
8,061,367 B2 11/2011 Rabe et al.
D650,669 S 12/2011 Dunwoody
D650,670 S 12/2011 Dunwoody
D651,082 S 12/2011 Dunwoody
8,113,218 B2 2/2012 Nguyen
8,127,774 B2 3/2012 Dinh
D657,496 S 4/2012 Flatt
D657,696 S 4/2012 Floyd et al.
D659,330 S 5/2012 Davis
8,171,943 B2 5/2012 Hamano
8,186,361 B2 5/2012 Hampton
D661,185 S 6/2012 Battat
D661,599 S 6/2012 Floyd et al.
8,191,556 B2 6/2012 Betts
8,196,591 B2 6/2012 Lee et al.
8,205,761 B2 6/2012 Stull, Sr. et al.
D663,113 S 7/2012 Simms
D664,011 S 7/2012 Affonso
8,225,800 B2 7/2012 Byrne
D669,223 S 10/2012 Lee et al.
D670,030 S 10/2012 Nguyen
D673,325 S 12/2012 Martines
8,342,186 B2 1/2013 Freelove
8,347,896 B2 1/2013 Liao
D679,590 S 4/2013 Stull, Sr. et al.
D679,591 S 4/2013 Stull, Sr. et al.
D679,592 S 4/2013 Stull, Sr. et al.
D679,595 S 4/2013 Stull, Sr. et al.
D679,596 S 4/2013 Stull, Sr. et al.
D682,103 S 5/2013 Jedlicka et al.
D682,688 S 5/2013 Murray
8,434,500 B2 5/2013 Alex
D686,495 S 7/2013 Murray
D690,419 S 9/2013 Porat
8,528,571 B2 9/2013 Costa
8,567,640 B1 10/2013 Johnson-Lofton
8,578,946 B2 11/2013 Ellery
8,596,284 B2 * 12/2013 Byrne ..... A41G 5/02
132/216
8,616,223 B2 12/2013 Rabe et al.
D698,078 S 1/2014 Purizhansky et al.

(56) References Cited

U.S. PATENT DOCUMENTS

| | | | |
|---|---|---|---|
| 8,657,170 | B2 | 2/2014 | Martinez |
| D700,799 | S | 3/2014 | Ludeman et al. |
| D702,510 | S | 4/2014 | Segal |
| 8,701,685 | B2 | 4/2014 | Chipman |
| D707,392 | S | 6/2014 | Yu et al. |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori et al. |
| D714,494 | S | 9/2014 | Vasquez et al. |
| 8,826,919 | B2 | 9/2014 | Dinh |
| D716,498 | S | 10/2014 | Wolff |
| D717,038 | S | 11/2014 | Lee |
| 8,875,718 | B2 | 11/2014 | Dinh |
| 8,881,741 | B1 | 11/2014 | Mattson et al. |
| 8,881,744 | B2 | 11/2014 | McKinstry |
| D718,901 | S | 12/2014 | Parker |
| 8,939,159 | B2 | 1/2015 | Yeo et al. |
| 8,967,158 | B2 | 3/2015 | Sanbonmatsu |
| 9,004,299 | B2 | 4/2015 | Hardin |
| 9,027,568 | B2 | 5/2015 | Lee |
| 9,044,076 | B2 | 6/2015 | Temple |
| 9,078,480 | B2 | 7/2015 | Beschta |
| 9,107,461 | B2 | 8/2015 | Martins et al. |
| D738,579 | S | 9/2015 | Owens et al. |
| D738,611 | S | 9/2015 | Gupta |
| 9,149,083 | B1 | 10/2015 | Dinh |
| 9,155,345 | B2 | 10/2015 | Nisim et al. |
| 9,179,722 | B2 | 11/2015 | Le |
| D746,046 | S | 12/2015 | Lee |
| D746,514 | S | 12/2015 | Lambridis et al. |
| 9,215,901 | B1 | 12/2015 | Schroeder |
| 9,254,012 | B2 | 2/2016 | Pham |
| D751,904 | S | 3/2016 | Landrum et al. |
| 9,277,777 | B2 | 3/2016 | Lee et al. |
| 9,284,111 | B2 | 3/2016 | Huang |
| D753,455 | S | 4/2016 | Hyma et al. |
| D753,881 | S | 4/2016 | Hussain et al. |
| 9,314,085 | B2 | 4/2016 | Hatch |
| D755,577 | S | 5/2016 | Segal |
| D757,274 | S | 5/2016 | Gelb et al. |
| D758,009 | S | 5/2016 | Berkos |
| 9,339,072 | B2 | 5/2016 | Kenna |
| 9,351,752 | B2 | 5/2016 | Slavin |
| D761,489 | S | 7/2016 | Krakovszki |
| D762,433 | S | 8/2016 | Yang |
| D764,688 | S | 8/2016 | Robinson et al. |
| D765,909 | S | 9/2016 | Marchica et al. |
| 9,439,465 | B2 | 9/2016 | Ott |
| 9,451,800 | B2 | 9/2016 | Dinh |
| 9,456,646 | B2 | 10/2016 | Calina |
| 9,462,837 | B2 | 10/2016 | Ngo |
| 9,468,245 | B2 | 10/2016 | Woods |
| 9,486,025 | B1 | 11/2016 | Dinh |
| 9,504,285 | B2 | 11/2016 | Lin |
| D773,915 | S | 12/2016 | Barakat et al. |
| D775,270 | S | 12/2016 | Moffat |
| 9,516,908 | B2 | 12/2016 | Miyatake et al. |
| 9,565,883 | B2 | 2/2017 | Dinh |
| 9,596,898 | B2 | 3/2017 | Seawright |
| D783,899 | S | 4/2017 | Roh |
| D783,901 | S | 4/2017 | Kim et al. |
| D784,615 | S | 4/2017 | Choi |
| 9,622,527 | B2 | 4/2017 | Nguyen |
| D788,556 | S | 6/2017 | James |
| 9,730,481 | B2 | 8/2017 | Uresti |
| D796,582 | S | 9/2017 | Beard |
| D800,966 | S | 10/2017 | Silva |
| D805,135 | S | 12/2017 | Beard |
| D806,315 | S | 12/2017 | Hardwick |
| 9,833,028 | B2 | 12/2017 | Jang et al. |
| 9,848,661 | B2 | 12/2017 | Harris et al. |
| 9,848,662 | B2 | 12/2017 | Dinh |
| D810,534 | S | 2/2018 | Liu |
| D810,543 | S | 2/2018 | Astradsson et al. |
| D811,872 | S | 3/2018 | Wu |
| D814,107 | S | 3/2018 | Lotti et al. |
| D814,260 | S | 4/2018 | Dhubb |
| 9,930,919 | B1 | 4/2018 | Branker et al. |
| D817,132 | S | 5/2018 | Yang |
| 9,993,373 | B2 | 6/2018 | Nassif et al. |
| D823,538 | S | 7/2018 | Ruggaber |
| D823,683 | S | 7/2018 | Caldwell |
| D825,333 | S | 8/2018 | Ozamiz et al. |
| D828,013 | S | 9/2018 | Van Wijngaarden et al. |
| D828,014 | S | 9/2018 | Van Wijngaarden et al. |
| D828,629 | S | 9/2018 | Hussain |
| D829,381 | S | 9/2018 | Kim |
| D830,170 | S | 10/2018 | Holmes |
| D832,701 | S | 11/2018 | Oates |
| D832,702 | S | 11/2018 | Oates |
| D835,465 | S | 12/2018 | Son et al. |
| D836,432 | S | 12/2018 | Riedel et al. |
| 10,149,528 | B2 | 12/2018 | Erickson et al. |
| D836,943 | S | 1/2019 | Klieman |
| D837,653 | S | 1/2019 | Meranus |
| D840,104 | S | 2/2019 | Hussain et al. |
| 10,264,837 | B2 | 4/2019 | Park |
| D847,631 | S | 5/2019 | Villbrandt |
| D847,632 | S | 5/2019 | Villbrandt |
| D848,795 | S | 5/2019 | Butler |
| D850,715 | S | 6/2019 | Lotti |
| D852,412 | S | 6/2019 | Grund et al. |
| 10,362,823 | B1 | 7/2019 | Hill et al. |
| D863,419 | S | 10/2019 | Oguma et al. |
| D863,679 | S | 10/2019 | Lotti |
| 10,433,607 | B2 | 10/2019 | Ahn |
| D867,664 | S | 11/2019 | Lotti |
| D867,668 | S | 11/2019 | Lotti |
| 10,479,566 | B2 | 11/2019 | Doyle et al. |
| D871,673 | S | 12/2019 | Qureshi et al. |
| 10,532,861 | B2 | 1/2020 | Kimmel et al. |
| D877,416 | S | 3/2020 | Lotti |
| 10,660,388 | B2 | 5/2020 | Lotti |
| D890,430 | S | 7/2020 | Lotti |
| 10,721,984 | B2 | 7/2020 | Lotti |
| D895,201 | S | 9/2020 | Lotti |
| D895,958 | S | 9/2020 | Guo et al. |
| D909,680 | S | 2/2021 | Hussain et al. |
| D914,965 | S | 3/2021 | Lotti |
| D917,153 | S | 4/2021 | Denei et al. |
| D918,475 | S | 5/2021 | Hu |
| D920,400 | S | 5/2021 | Saito |
| D920,465 | S | 5/2021 | Bould et al. |
| D930,788 | S | 9/2021 | Roth |
| D932,101 | S | 9/2021 | Davis et al. |
| 11,219,260 | B2 | 1/2022 | Lotti |
| 11,234,472 | B2 | 2/2022 | Lotti |
| 11,253,020 | B2 | 2/2022 | Lotti |
| 11,330,855 | B2 | 5/2022 | Lotti |
| 11,330,856 | B2 | 5/2022 | Lotti |
| 2001/0023699 | A1 | 9/2001 | Matthews |
| 2001/0035192 | A1 | 11/2001 | Townsend |
| 2001/0037813 | A1 | 11/2001 | Ra |
| 2002/0056465 | A1 | 5/2002 | Shin |
| 2002/0094507 | A1 | 7/2002 | Feuer |
| 2002/0114657 | A1 | 8/2002 | Gueret |
| 2002/0198597 | A1 | 12/2002 | Godfrey |
| 2003/0005941 | A1 | 1/2003 | Iosilevich |
| 2003/0111467 | A1 | 6/2003 | Norman et al. |
| 2003/0155317 | A1 | 8/2003 | McNeeley et al. |
| 2003/0226571 | A1 | 12/2003 | Rahman |
| 2004/0011371 | A1 | 1/2004 | Harrison |
| 2004/0011372 | A1 | 1/2004 | Park |
| 2004/0211436 | A1 | 10/2004 | Knight |
| 2005/0061341 | A1 | 3/2005 | Choe |
| 2005/0098190 | A1 | 5/2005 | Kim |
| 2005/0098191 | A1 | 5/2005 | Frazier |
| 2005/0115581 | A1 | 6/2005 | Choi |
| 2005/0166939 | A1 | 8/2005 | Stroud |
| 2005/0194015 | A1 | 9/2005 | Watts |
| 2005/0247326 | A1 | 11/2005 | Park |

(56) References Cited

U.S. PATENT DOCUMENTS

2005/0252517 A1 11/2005 Salinas
2005/0252518 A1 11/2005 Salinas
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe et al.
2006/0129187 A1 6/2006 Cho
2006/0142693 A1 6/2006 Kahen
2006/0175853 A1 8/2006 Anderson et al.
2006/0180168 A1 8/2006 Dinnel
2006/0180171 A1 8/2006 Kim
2006/0266376 A1 11/2006 Basso
2007/0023062 A1 2/2007 McKinstry et al.
2007/0050207 A1 3/2007 Merszei
2007/0084749 A1 4/2007 Demelo et al.
2007/0157941 A1 7/2007 Awad et al.
2007/0157944 A1 7/2007 Catron et al.
2007/0199571 A1 8/2007 McCulloch
2007/0221240 A1 9/2007 Junsuh Lee
2007/0227550 A1 10/2007 Merszei
2007/0272263 A1 11/2007 Gold
2007/0272264 A1 11/2007 Byrne
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita et al.
2009/0028625 A1 1/2009 Bonneyrat
2009/0071490 A1 3/2009 Sthair
2009/0071492 A1 3/2009 Oh
2009/0178689 A1 7/2009 Navarro et al.
2009/0217936 A1 9/2009 Sato et al.
2009/0217939 A1 9/2009 Rabe et al.
2009/0223534 A1 9/2009 Green
2009/0241973 A1 10/2009 Hampton
2009/0241979 A1 10/2009 Navarro et al.
2009/0255547 A1 10/2009 Starks et al.
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie et al.
2010/0170526 A1 7/2010 Nguyen
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim et al.
2011/0278869 A1 11/2011 Lee et al.
2011/0290271 A1 12/2011 Rabe et al.
2011/0290937 A1 12/2011 Salkeld
2012/0037177 A1 2/2012 Teater Makinen
2012/0055499 A1 3/2012 Sanbonmatsu
2012/0160259 A1 6/2012 Nguyen et al.
2012/0174939 A1 7/2012 Starks et al.
2012/0180804 A1 7/2012 Hochi et al.
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon et al.
2013/0160783 A1 6/2013 Ahn et al.
2013/0167855 A1 7/2013 Kupitz
2013/0167858 A1 7/2013 Lee
2013/0255706 A1 10/2013 Dinh
2013/0276807 A1 10/2013 Teater Makinen
2013/0298931 A1 11/2013 Samain et al.
2013/0306089 A1 11/2013 Araujo Costa
2013/0306094 A1 11/2013 West
2013/0312781 A1 11/2013 Murphy
2013/0312782 A1 11/2013 Kindall
2013/0320025 A1 12/2013 Mazzetta et al.
2013/0333714 A1 12/2013 Merszei
2014/0011372 A1 1/2014 Kato et al.
2014/0060559 A1 3/2014 Lin
2014/0069451 A1 3/2014 Hwang
2014/0083447 A1 3/2014 Rabe et al.
2014/0110304 A1 4/2014 Wu et al.
2014/0116456 A1 5/2014 Palmer-Rogers
2014/0135914 A1 5/2014 Conant
2014/0216488 A1 8/2014 Dinh
2014/0332025 A1 11/2014 Kim et al.
2015/0020840 A1 1/2015 Rabe et al.
2015/0075549 A1 3/2015 Lee et al.
2015/0114421 A1 4/2015 Pham
2015/0114422 A1 4/2015 Abraham et al.
2015/0114423 A1 4/2015 Sanbonmatsu
2015/0128986 A1 5/2015 Stookey
2015/0136162 A1 5/2015 Brouillet et al.
2015/0173442 A1* 6/2015 Raouf ..... A41G 5/02 132/286
2015/0181967 A1 7/2015 Dinh
2015/0201691 A1 7/2015 Palmer-Rogers
2015/0201692 A1 7/2015 Hansen et al.
2015/0216246 A1 8/2015 Ahn et al.
2015/0351467 A1* 12/2015 Simoes ..... A41D 13/08 700/98
2016/0016702 A1 1/2016 Siskindovich et al.
2016/0037847 A1 2/2016 Tavakoli
2016/0037848 A1 2/2016 Lee
2016/0050996 A1 2/2016 Kwon
2016/0058088 A1 3/2016 Le
2016/0088889 A1 3/2016 Kettavong
2016/0135531 A1 5/2016 Ezechukwu
2016/0174645 A1 6/2016 Goldner
2016/0192724 A1 7/2016 Scott et al.
2016/0192725 A1 7/2016 Merszei
2016/0206031 A1 7/2016 Stoka
2016/0219959 A1 8/2016 Chipman et al.
2016/0286881 A1 10/2016 Ko
2016/0324241 A2 11/2016 Lee
2016/0324242 A1 11/2016 Hansen et al.
2016/0345648 A1 12/2016 Miniello et al.
2016/0353821 A1 12/2016 Calina
2016/0353861 A1* 12/2016 Carey ..... A41G 5/02
2017/0000204 A1 1/2017 Wibowo
2017/0006947 A1 1/2017 Uresti
2017/0020219 A1 1/2017 Beschta
2017/0049172 A1 2/2017 Ahn
2017/0049173 A1 2/2017 Dinh
2017/0055615 A1 3/2017 Crocilla
2017/0079356 A1 3/2017 Dinh
2017/0079357 A1 3/2017 Dinh
2017/0079358 A1 3/2017 Dinh
2017/0112214 A1 4/2017 Ahn
2017/0112215 A1 4/2017 Dinh
2017/0112264 A1* 4/2017 Park ..... A45D 44/00
2017/0127743 A1 5/2017 Nakamura et al.
2017/0150763 A1 6/2017 Schroeder
2017/0208885 A1 7/2017 Alex
2017/0231309 A1 8/2017 Han
2017/0258163 A1 9/2017 Uresti
2017/0265550 A1 9/2017 Han et al.
2017/0311667 A1 11/2017 Passariello et al.
2017/0340041 A1 11/2017 Nguyen
2017/0347731 A1 12/2017 Chipman et al.
2017/0358245 A1 12/2017 Dana
2017/0360134 A1 12/2017 Crocilla
2017/0360135 A1 12/2017 Ahn
2017/0360136 A1 12/2017 Ferrier et al.
2018/0065779 A1 3/2018 Chiba
2018/0098591 A1 4/2018 Leeflang
2018/0160755 A1 6/2018 Hansen et al.

(56) References Cited

U.S. PATENT DOCUMENTS

| | | | |
|---|---|---|---|
| 2018/0235299 | A1 | 8/2018 | Stoka |
| 2018/0242671 | A1 | 8/2018 | Merszei |
| 2018/0242672 | A1 | 8/2018 | Lotti |
| 2018/0242715 | A1 | 8/2018 | Lotti |
| 2018/0352885 | A1 | 12/2018 | Kim |
| 2018/0352886 | A1 | 12/2018 | Schroeder et al. |
| 2019/0133227 | A1 | 5/2019 | Le |
| 2019/0191851 | A1 | 6/2019 | Esposito et al. |
| 2019/0254373 | A1 | 8/2019 | Kim |
| 2019/0254374 | A1 | 8/2019 | Schroeder |
| 2020/0093211 | A1 | 3/2020 | Lee |
| 2020/0260839 | A1 | 8/2020 | Lotti |
| 2021/0030140 | A1 | 2/2021 | Chico |

FOREIGN PATENT DOCUMENTS

| | | | |
|---|---|---|---|
| CN | 203897379 | U | 10/2014 |
| CN | 104363790 | A | 2/2015 |
| CN | 205274180 | U | 6/2016 |
| CN | 302315323 | | 6/2016 |
| CN | 303086463 | | 6/2016 |
| CN | 304049505 | | 6/2016 |
| CN | 304049506 | | 6/2016 |
| CN | 304310042 | | 6/2016 |
| CN | 304329374 | | 6/2016 |
| CN | 304329375 | | 6/2016 |
| CN | 304382151 | | 6/2016 |
| CN | 304452297 | | 6/2016 |
| CN | 304497372 | | 6/2016 |
| CN | 304777737 | | 6/2016 |
| CN | 304859863 | | 6/2016 |
| CN | 304859864 | | 6/2016 |
| CN | 305738664 | | 6/2016 |
| CN | 305916370 | | 6/2016 |
| EP | 1839526 | A1 | 10/2007 |
| EP | 006381257 | | 6/2016 |
| EP | 006381257-0002 | | 5/2019 |
| EP | 006381257-0003 | | 5/2019 |
| GB | 190218723 | A | 11/1902 |
| GB | 1021063 | A | 2/1966 |
| GB | 1042020 | * | 9/1966 |
| GB | 1272616 | A | 5/1972 |
| GB | 1307107 | A | 2/1973 |
| JP | S484711 | | 1/1973 |
| JP | 1978-083862 | | 7/1978 |
| JP | 2009040718 | A | 2/2009 |
| JP | 3157680 | * | 2/2010 |
| JP | 2011500979 | A | 1/2011 |
| JP | 2011122288 | A | 6/2011 |
| JP | 2011177395 | A | 9/2011 |
| JP | 2015105447 | A | 6/2015 |
| JP | 3201846 | * | 1/2016 |
| JP | 3201846 | U | 1/2016 |
| JP | 2016027220 | A | 2/2016 |
| JP | 2016163699 | A | 9/2016 |
| JP | 2019522125 | A | 8/2019 |
| KR | 200165452 | Y1 | 2/2000 |
| KR | 2001654552 | | 2/2000 |
| KR | 200240234 | * | 10/2001 |
| KR | 200260653 | * | 1/2002 |
| KR | 200395554 | Y1 | 9/2005 |
| KR | 20060010717 | A | 2/2006 |
| KR | 439673 | * | 4/2008 |
| KR | 20090010717 | A | 1/2009 |
| KR | 101336422 | B1 | 12/2013 |
| KR | 101509029 | B1 | 12/2013 |
| KR | 101566166 | * | 11/2015 |
| KR | 20150140672 | A | 12/2015 |
| KR | 20190035787 | A | 4/2019 |
| RU | 2558482 | C1 | 8/2015 |
| WO | 2014163364 | A1 | 10/2014 |
| WO | 2018022914 | A1 | 2/2018 |
| WO | 2018119034 | A1 | 6/2018 |

OTHER PUBLICATIONS

United States District Court District of California San Francisco Division, 3:20-cv-06086, *Lashify, Inc*. v. *Alicia Zeng and Patrick Ellsworth d/b/a Lilac St; and Artemis Family Beginnings, Inc*.

U. S. International Trade Commission, Inv. No. 337-TA-1226, In the Matter of Certain Artificial Eyelash Extension Systems, Products, and Components Thereof.

Patent Trial and Appeal Board (PTAB), PGR2021-00046, *Kiss Nail Products, Inc* (Petitioner) v. *Lashify, Inc* (Patent Owner).

Patent Trial and Appeal Board (PTAB), PGR2021-00045, *Kiss Nail Products, Inc* (Petitioner) v. *Lashify, Inc* (Patent Owner).

Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).

International Search Report and Written Opinion dated Mar. 12, 2018 in related PCT/US2017/067513 filed Dec. 20, 2017 (10 pages).

International Search Report and Written Opinion dated Dec. 19, 2019 in related PCT/US2019/057104 filed Oct. 19, 2019 (8 pages).

International Search Report and Written Opinion dated Dec. 23, 2019 in related PCT/US2019/057102 filed Oct. 19, 2019 (8 pages).

International Search Report and Written Opinion dated Nov. 27, 2017 in related PCT/US2017/044217 filed Jul. 27, 2017 (10 pages).

International Search Report and Written Opinion dated May 7, 2020, on application No. PCT/US2020/013561.

International Search Report and Written Opinion dated on Jan. 20, 2021 on application No. PCT/US20/54014.

Japonesque False Lash Applicator, https://japonesque.com/products/implements/false-lash-applicator/, downloaded from internet Feb. 13, 2019 (6 pages).

"Kiss—Ever Ez Lashes 30 Count Trio Lashes in Various Lengthshttps://www.amazon.com/Kiss-Lahes-Lashes-Various-Lengths/dp/B00JH7SP4S; Retrieved Mar. 9, 2021".

"Kiss—i-Envy 100% Human Eyelash So Wispy 03;https://www.pinterest.co.kr/pin/308285536984155041/Retrieved Dec. 30, 2020".

"Kiss—I-Envy by Kiss 100% Human Pre Cut Eyelash Quattro 02 Lashes, https://www.pinterest.cl/pin/576038608568497288/?amp_client_id=CLIENT_ID(_)&mweb_unauth_id=&from_amp_pin_page=true, Retrieved Dec. 30, 2020".

"Kiss—I-Envy by Kiss Premium Quattro 02 Lashes, https://www.lashaddict.nl/kiss-i-envy-lashes-quattro-02.html, Retrieved Dec. 30, 2020".

"Kiss—I-Envy by Kiss Premium Quattro 02 Lashes, https://www.ubuy.com.kw/en-sa/catalog/product/view/id/37236, Retrieved Dec. 30, 2020".

"Kiss—I-Envy by Kiss Premium Quattro 02 Lashes, https://www.walmart.com/ip/Kiss-I-Envy-Quattro-02-Lashes/187353459, Retrieved Dec. 30, 2020".

"Kiss—iEnvy Collection;ienvybykiss.com; Retrieved Dec. 30, 2020".

"Kiss—I-Envy Eye Lash Adhesive (6g Individual, Clear) Reviews; https://www.influenster.com/reviews/kiss-i-envy-eye-lash-adhesive-6g-individual-clear; Retrieved Dec. 30, 2020".

"Kiss—I-Envy Individual Eye Lash Adhesive; https://www.modernbeauty.com/cosmetics/lashes/false-lashes/product/26961-i-envy-individual-eyelash-adhesive-retail.html;Retrieved Dec. 30, 2020".

"Kiss—i-Envy Pre-Cut Lashes, https://www.shopbeautylicious.com/products/kiss-i-envy-pre-cut-lashes; Retrieved Dec. 30, 2020".

"Kiss—i-Envy Premium Quattro 01 Lashes, https://www.amazon.ca/Kiss-ienvy-quattro-Makeup-Count/dp/B016SKJJKM; Retrieved Dec. 30, 2020".

"Kiss—i-Envy Premium Quattro 01 Lashes, https://www.ammancart.com/products/kiss-i-envy-premium-quattro-01-lashes-kpe62; Retrieved Dec. 30, 2020".

"Kiss—i-Envy Premium Quattro 01 Lashes, https://www.beautyproductsusa.com/home/322-kiss-i-envy-strip-eyelash-quattro-01-kpe62.html; Retrieved Dec. 30, 2020".

"Kiss—i-Envy Premium Quattro 01 Lashes, https://www.bicoastalbeauti.com/shop/kiss-brand-lashes/kiss-i-envy-premium-quattro/; Retrieved Dec. 30, 2020".

(56) References Cited

OTHER PUBLICATIONS

"Kiss—i-Envy Premium Quattro 01 Lashes, https://www.biloltd.net/product-p/60351.htm; Retrieved Dec. 30, 2020".
"Kiss—i-Envy Premium Quattro 01 Lashes, https://www.cashmerecosmetics.com/product/kiss-i-envy-quattro-01-lashes/; Retrieved Dec. 30, 2020".
"Kiss—i-Envy Premium Quattro 01 Lashes, https://www.ebay.com/p/1044019861; Retrieved Dec. 30, 2020".
"Kiss—i-Envy Premium Quattro 01 Lashes, https://www.loveyelashes.com/bfont-colorgreenstrip-lashesfontb-299-ienvy-by-kiss-quattro-01-(1555,129,1,48)p.html#; Retrieved Dec. 30, 2020".
"Kiss—i-Envy Premium Quattro 01 Lashes, https://www.ussalonsupply.com/Kiss-I-Envy-Quattro-01-Lashes-_p_120305.html; Retrieved Dec. 30, 2020".
Kiss—i-Envy Premium Quattro 01 Lashes, https://www.madamemadeline.com/online_shoppe/proddetail.asp?prod=mmKPE62; Retrieved Dec. 30, 2020.
"Kiss—i-Envy Quattro 01 Lashes, pack of 3https://www.amazon.com/iEnvy-Kiss-Quattro-Lashes-Pack/dp/B06XGBTCHW; Retrieved Dec. 30, 2020".
"Kiss—i-Envy Quattro 02 Lashes, pack of 3https://www.amazon.com/iEnvy-Kiss-Quattro-Lashes-Pack/dp/B017O6J2FG; Retrieved Dec. 30, 2020".
Search Report and Written Opinion dated Jan. 21, 2022, on Application No. SG. 10202106633V.
"Kiss—i-Envy Ultra Black Trio Medium Lashes, 2 pk.https://www.amazon.com/Kiss-Envy-Ultra-Black-Medium/dp/B00W2C4HPS?th=1; Retrieved Mar. 9, 2021".
Kiss—So Wispy 01 Strip Eyelashes, https://picclick.com/i-ENVY-by-Kiss-SO-WISPY-01-Strip-Eyelashes-292311410878.html; Retrieved Dec. 30, 2020.
"Kiss Ever EZ Trio Lashes Medium Combo 30 EA 2pk,https://www.ebay.com/urw/Kiss-Ever-EZ-Trio-Lashes-Medium-Combo-30-EA-2pk/product-reviews/111 7964400?pgn=2#Retrieved on Mar. 9, 2021".
Kiss Nail Products, Inc.'S Third Supplemental Objections and Responses to Lashify, Inc.'S First Set of Interrogatories (Nos. 1-56) Investigation No. 337-TA-1226, Mar. 10, 2021.
Lashify Gossamer Lash Cartridge https://lashify.com/collections/shop-1/products/gossamer-eye-lozenge-c-style?variant=783670738950, downloaded from internet Jun. 15, 2018 (2 pages).
Lashify Wand, https://iwww.instagrarn.com/p/BWgeQ8wg00S/?iqshid=zauiyw8a6v5, downloaded from internet 2019 (1 page).
Lindström, I., Suojalehto, H., Henriks-Eckerman, M.L. and Suuronen, K., 2013. Occupational asthma and rhinitis caused by cyanoacrylate-based eyelash extension glues. Occupational medicine, 63(4), pp. 294-297.
MAC Cosmetics, 34 Lash, http://www.bornpretty/store.com/false-eyelashes-thick-natural-simulation-recyclable-curly-false-eyelash-makeup-cosmetic-tools-p-44675.html, downloaded from internet Feb. 14, 2019 (1 page).
Madame Madeline got lashes? Kiss i-Envy Premium Quattro 01 Lashes (KPE62), i-Envy Strip Lashes by Kiss—Madame Madeline Lashes, retrieved Dec. 30, 2020.
"Madame Madeline Lashes, Ardell Dual Lash Applicator, https://www.madamemadeline.com/online_shoppe/proddetail.asp?prod=mm62059, downloaded frominternet Oct. 18, 2018 (3 pages)."
Made In China, New Product Eyelashes Aid Eyelashes Applicator Innovative Eyelashes Curler, 2018, https://www.made-in-china.com/productdirectory.do?word=creative+eyelashe+curler&subaction=hunt&style=b&mode=and&code=0&comProvince=nolimit&order=0&isOpenCorrection=1, downloaded from internet Feb. 13, 219(2 pages).
Notter E. The Art of the Chocolatier: From Classic Confections to Sensational Showpieces. John Wiley & Sons; Jan. 18, 2011.
Pak Lajpall, Nail Artist Tweezers PL-1, http://www.laipall.com/proddetail.prod=nail-artists-tweezers 1, downloaded from internet Feb. 13, 2019 (1 paqe).
Peonies and Lilies, Bourjois 2 in 1 Tweezers and Faux & Fabulous Eyelashes, Posted Oct. 24, 2012 (2 pages).
"Pinterest—How to Apply iEnvy Quattro collection eyelashes,https://www.pinterest.com/pin/43347215141316080/ Retrieved Dec. 30, 2020".
Pinterest search for False Eyelases: Kiss Premium Lashes, i-Envy by Kiss Premium Lashes, Lashes, False eyelashes, eyelashes; https://www.pinterest.es/amp/pin/449515606533816815/, Retrieved Dec. 30, 2020.
Pinterest search from kissusa.com; https://www.pinterest.com.au/pin/19562579608263895/; Retrieved Dec. 30, 2020.
Satkowski, M.M., 1990. The crystallization and morphology of polyethylene and its blends.
Siegmann, A. and Harget, P.J., 1980. Melting and crystallization of poly (ethylene terephthalate) under pressure. Journal of Polymer Science: Polymer Physics Edition, 18(11), pp. 2181-2196.
This DIY Lash Extension Kit Has Ruined Mascara for Me Forever, elle.com/beauty/makeup-skin-care/a20704236/lashify-lashes-kit-review/ By Kristinaa Rodulfo, May 16, 2018.
Troughton MJ. Handbook of plastics joining: a practical guide. William Andrew; Oct. 17, 2008.
Varga J, Ehrenstein GW, Schlarb AK. Vibration welding of alpha and beta isotactic polypropylenes: Mechanical properties and structure. Express Polymer Letters. Mar. 1, 2008;2(3):5-19.
www.ubuy.com.kwen-sa/catalog/productiview/id/37236 I envy by Kiss Preminum Qutrro 02 Lash buy only ubuy Qatar, Dec. 30, 2020.
A True Lash Extension Look in Minutes Falscara the New Way to Lash, https://www.kissusa.com/falscara-false-eyelash-extension-look, retrieve on Feb. 5, 2021.
"Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu . . . , downloaded from internet Oct. 10, 2018 (3 pages)."
"Amazon.com : Kiss Ever Ez Lahes 30 Count Trio Lashes in Various Lengths 57927 : Beautyhttps://www.amazon.com/Kiss-Lahes-Lashes-Various-Lengths/dp/BOOJH7SR4SRetrieved on Mar. 9, 2021".
Aug. 18, 2015 "How to apply iEnvy Quattro collection eyelashes" Quatro Video—https://www.youtube.com/watch?v=KW-ovIGoCmc.
"BL Kiss Envy Quattro 01 Lashes—Two Pack, https://www.ebay.ca/itm/BL-Kiss-I-Envy-Quattro-O 1-Lashes-Two-PACK-/293706028541, Retrieved on Dec. 30, 2020".
Born Pretty, False Eyelashes Thick Natural Simulation Recyclable Curly False Eyelash Makeup Cosmetic Tools, http://www.bornprettystore.com/false-eyelashes-thick-natural-simulation-recyclable-curly-false-eyelash-makeup-cosmetic-tools-p-44675.html downloaded from internet Oct. 18, 2018 (6 pages).
Brandrup, J., Immergut, E.H., Grulke, E.A., Abe, A. and Bloch, D.R. eds., 1999. Polymer handbook (vol. 89). New York: Wiley.
Buy Korea, Plastic, False Eyelash Applicator, Multy colour, http://www.buykorea.or.kr/product-details/Plastic-False-Eyelash-Applicator-Multy-colour-3106709.html, downloaded from internet Feb. 14, 2019 (3 pages).
Buzludzha Monument, Gueorguy Stoilov circa 1980, justanotherbackpacker.com, published by blogger Rich on Apr. 29, 2014 © 2019, online, site visited Aug. 27, 2019. Downloaded from Internet, URL: http://www.justanotherbackpacker.com/ buzludzha-monument-bulgaria-ufo/ (Year: 2014).
Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).
Cruiser Portable Speaker, NYNE, published at thegamerwithkids.com, posted by Sam Versionone on Apr. 6, 2015 © not listed, online, cite visited Jun. 20, 2018. Available from Internet. URL: https://thegamerwithkids.com/2015/04/06/nyne-cruiser-review-a-wireless-speaker-for-your-bycicle/ (Year: 2015).
Delicate Hummingbird, Ha! I've mastered the false lashes!, http://delicate hummingbird.blogspot.com/2011/11/ha-ive-mastered-false-lashes.htm., Nov. 10, 2011 (12 pages).
Dream Lashes Curved Volume Tweezer—3 Minute Test, https://www.youtube.com/watch?v:cw1qYeEOSD7s, downloaded from the Internet Feb. 13, 2019 (1 page).

(56) References Cited

OTHER PUBLICATIONS

Electron Microscopy Sciences, "EMS High Precisions and Ultra Fine Tweezers." https://www.emsdiasum.com/microscopy/products/tweezers/ultra_fine.aspx. Downloaded from the Internet Feb. 13, 2019 (7 pages).
European Search Report issued in EP17835287A dated Feb. 11, 2020 (5 pages).
European Search Report issued in EP17884561A dated Sep. 11, 2020 (7 pages).
Eyelash Tweezers—FEITA Precision Eyelash Extension Tweezers Set—Professional Straight & Curved Pointed Very Fine Tip Tweezers for Lash Extensions—Black—2Pcs, amazon.com/Eyelash-Tweezers-Precision-Extension-Professional/dp/B0112KSUDS.
"Eyelashes Clip—2 Pieces False Eyelashes Applicator Tool Eyelash Extension Tweezers Remover Clip Nipperamazon.co.uk/Eyelashes-Clip-Applicator-Extension-Tweezers/dp/B07PK6VBVW".
First Office Action issued in CN201780004312A dated May 7, 2020 (17 pages).
First Office Action issued in CN201780033755A dated Aug. 28, 2020 (8 pages).
Focallure, https://shopfocallure.com/collections/eyelashes/products/eyelash-tweezer-by-focallure, downloaded from internet Feb. 14, 2019 (1 page).
Hollyren, DIY Eyelash Extensions Superfine Band Cluster Lashes Kit, retrieve Feb. 5, 2021.
Hongjun web page, https://detail.1686.com/offer/574685154963.html?spm=a2615.7691456.newlist.75.22f96dc5Msy00t, downloaded from internet Oct. 31, 2018 (16 pages).
How to Apply Lashing using Sephora Bull Eye Lash Applicator, Nov. 14, 2012 youtube video, https://www.youtube.com/watch?v=yYwcYZXJX4M.
https://picclick.com/i-ENVY-by-kiss-SO-Wispy-01-Strip-Eyelashes-292311410878.html, retrieved Dec. 30, 2020.
https://www.bicoastalbeauti.com/shop/kiss-brand-lashes/kiss-i-envy-premium-quattro/ Kiss i-Envy Premium Quattro 01 Lashes (KPE62), retrieved Dec. 30, 2020.
https://www.ebay.com/sch/i.html?_nkw=lenvy&norover=1&mkevet=1&mkevt=1&mkrid=711-156598-701868-2&mkcid=2&keywprd=ienvy&crip=435059434779_&, lenvy, retrieved Dec. 30, 2020.
https://www.madamemadeline.com/online_shoppe/proddetail.asp?prod=mmKPE62, Kiss i-Envy Premium Quattro 01 Lashes (KPE62), retrieved Dec. 30, 2020.
I-Envy by Kiss SO Wispy #01 Strip Eyelashes KPE58 False Lashes Black 1 pair NEW, https://www.picclickimg.com/d/w1600/picV292311410878 li-ENVY-by-Kiss-SO-WISPY-01-Strip-Eyelashes.jpg) retrieved Dec. 30, 2020.
Ienvy https://www.ebay.com/sch/i.html? _ nkw=lenvy&norover=1&mkevt=1&mkrid=711-156598-701868-2&mkcid=2&keyword=ienvy&crlp=435059434779, retrieved Dec. 30, 2020.
"Kiss—i-Envy Strip Eyelashes—Pack of 2,https://www.ebay.com.au/itm/Kiss-I-Envy-Strip-Eyelashes-Pack-of-2-Choose-your-Style/183303124469; Retrieved Dec. 30, 2020".
"Kiss—i-Envy Trio Lashes Ultra Volumehttps://www.unitedbeautysupply.com/product/kiss-i-envy-trio-lashes-ultra-volume-kpec/; Retrieved Mar. 9, 2021".
"Kiss—i-Envy Trio Medium Lashes 30 Trio Lashes, 2 pk.https://www.amazon.com/Kiss-Envy-Trio-Medium-Lashes/dp/B018J0RMXU; Retrieved Mar. 9, 2021".

* cited by examiner

STORAGE CASE FOR ARTIFICIAL LASH EXTENSIONS

CROSS-REFERENCE TO RELATED APPLICATIONS

This application is a continuation application of U.S. patent application Ser. No. 16/867,391, filed May 5, 2020, which is a divisional of U.S. patent application Ser. No. 15/968,453, filed on May 1, 2018, now issued as U.S. Pat. No. 10,638,826, issued on May 5, 2020, which is a continuation of International Application No. PCT/US17/67513, filed on Dec. 20, 2017, which claims priority to U.S. Provisional Application No. 62/436,585, filed on Dec. 20, 2016. The contents of the above applications are incorporated herein by reference in their entirety.

FIELD OF THE INVENTION

Various embodiments concern cases for housing artificial eyelashes and applicators for applying artificial eyelashes to the underside of an individual's natural eyelashes.

BACKGROUND

Eyelash extensions have conventionally been used to enhance the length, thickness, and fullness of natural eyelashes. Eyelash extensions, however, must be applied to an individual's natural eyelashes one by one to avoid having the eyelash extensions stick together. Consequently, lash extension services can cost hundreds of dollars depending on the type and number of lashes used, the skill of the cosmetician, and the venue where the eyelash extensions are applied. It usually takes an experienced cosmetician one to two hours to attach a full set of eyelash extensions.

Clusters of artificial lashes have conventionally been used to enhance the length, thickness, and fullness of an individual's natural eyelashes. However, each cluster must be applied to the individual's eyelashes individually in order to avoid having the clusters of artificial lashes stick together and to ensure multiple clusters are evenly distributed across the width of the individual's lash line.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

BRIEF DESCRIPTION OF THE DRAWINGS

Various embodiments are illustrated by way of example and not limitation in the accompanying drawings, in which like references indicate similar elements. Various objects, features, and characteristics of the present invention will become more apparent to those skilled in the art from a study of the Detailed Description in conjunction with the drawings.

Figure 1:
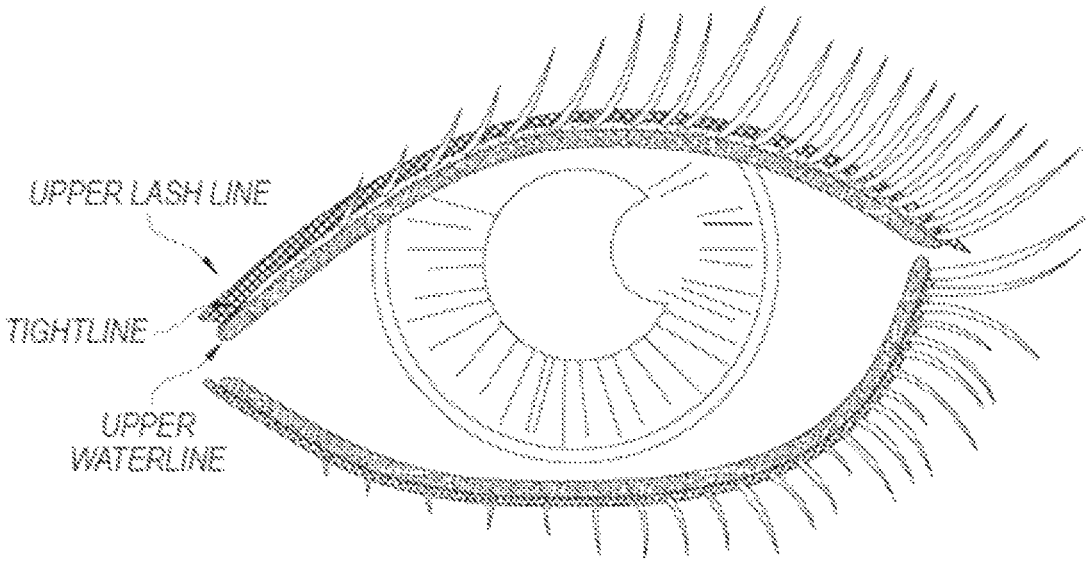
FIG. 1 depicts the upper tightline, upper lash line, and upper waterline of an eyelid.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Conventional eyelash extensions (or simply "lash extensions") are individually adhered to an individual's natural eyelashes one-by-one in order to prevent the eyelash extensions from sticking together. However, because the average individual might have anywhere from thirty to eighty natural lashes per eye, the application process can take several hours to attach a full set of lash extensions.

Introduced here are cases for housing sets of artificial lash extensions that can be applied to an individual's natural lashes. Each set of artificial lash extensions can include multiple lash fusions, and each lash fusion can include multiple clusters of artificial lashes. These clusters include multiple artificial hairs made of natural materials (e.g., silk or authentic mink hair) or synthetic materials (e.g., acrylic resin, polybutylene terephthalate (PBT), or synthetic mink hair made of polyester). A cluster of artificial lashes generally includes approximately 10 to 30 artificial hairs (and preferably 10 to 20 artificial hairs). While certain embodiments have been described in the context of lash fusions that include multiple clusters, those skilled in the art will recognize that a lash fusion could also include a series of individual artificial hairs that are connected to one another.

Multiple clusters of artificial lashes are often formed into bundles called "lash fusions." The base of a lash fusion (e.g., where multiple clusters are fused together) is intended to be affixed to an individual's natural lashes. A lash fusion may be approximately 4-8 millimeters (mm) wide. A lash fusion could also include 3-10, 3-7, 5-10, 5-7, or 4-6 clusters. Accordingly, a lash fusion could include 30-150, 30-120, or 30-90 individual artificial hairs. A set of artificial lash extensions can then be formed by positioning multiple lash fusions next to one another in an arrangement that substantially matches the curvature of the upper tightline along the base of the eyelid.

While the multiple lash fusions included in a set of artificial lash extensions are typically not connected to one another (e.g., are not fused together using heat, an adhesive, etc.), the entire set of artificial lash extension can be applied to the underside of the individual's natural lashes in a single motion by an applicator. Thus, the multiple lash fusions in a set of artificial lash extensions may be arranged to match the curvature of an eyelid, as well as an applicator designed to facilitate fixation of the entire set of artificial lash extensions to an individual's natural lashes. A set of artificial lash extensions could include 3-8, 3-5, 5-8, or 4-6 lash fusions. Accordingly, a set of artificial lash extensions could include 150-360 individual artificial hairs.

Also introduced here are applicators for resiliently grasping the multiple lash fusions in a set of artificial lash extensions, and then simultaneously applying the multiple lash fusions along the upper tightline in a single motion. As shown in FIG. 1, the upper tightline is interposed between the upper lash line and the upper waterline. An applicator includes opposed arms that are connected to one another at an inner end (also referred to as the "proximal end") that is gripped by an individual. The applicator can also include an outer end (also referred to as the "distant end" or the "distal end") having a concave (e.g., crescent) shape that is contoured to be substantially flush with the convex shape of the upper tightline. The concave shape of the applicator may also substantially complement the predefined indentations within cases that are responsible for holding sets of artificial lash extensions. Applicators are often comprised of metal (e.g., stainless steel, hardened steel, or titanium) to increase the durability and grasping precision of the opposed arms.

An adhesive may be applied to the top of each lash fusion in a set of artificial lash extensions during the manufacturing process, which enables an individual to easily apply the set of artificial lash extensions directly to the underside of the natural lashes rather than to the eyelid. Additionally or alternatively, the individual could apply an adhesive before applying the set of artificial lash extensions to the underside of the natural lashes. For example, the individual may apply an adhesive to each lash fusion before applying the set of artificial lash extensions to the natural lashes. As another example, the individual may apply an adhesive directly to the natural lashes. Thus, the adhesive could be a waterproof glue or mascara.

Terminology

Brief definitions of terms, abbreviations, and phrases used throughout this application are given below.

Reference to "one embodiment" or "an embodiment" means that a particular feature, structure, or characteristic described in connection with the embodiment is included in at least one embodiment of the disclosure. The appearances of the phrase "in some embodiments" are not necessarily referring to the same embodiment, nor are they necessarily referring to separate or alternative embodiments that are mutually exclusive of one another.

The terms "connected," "coupled," or any variant thereof includes any connection or coupling between two or more elements, either direct or indirect. The coupling or connection between the elements can be physical, logical, or a combination thereof. For example, two components may be coupled directly to one another or via one or more intermediary channels/components. The words "associate with," meanwhile, mean connecting or relating objects, items, etc.

System Topology Overview

Figure 2:
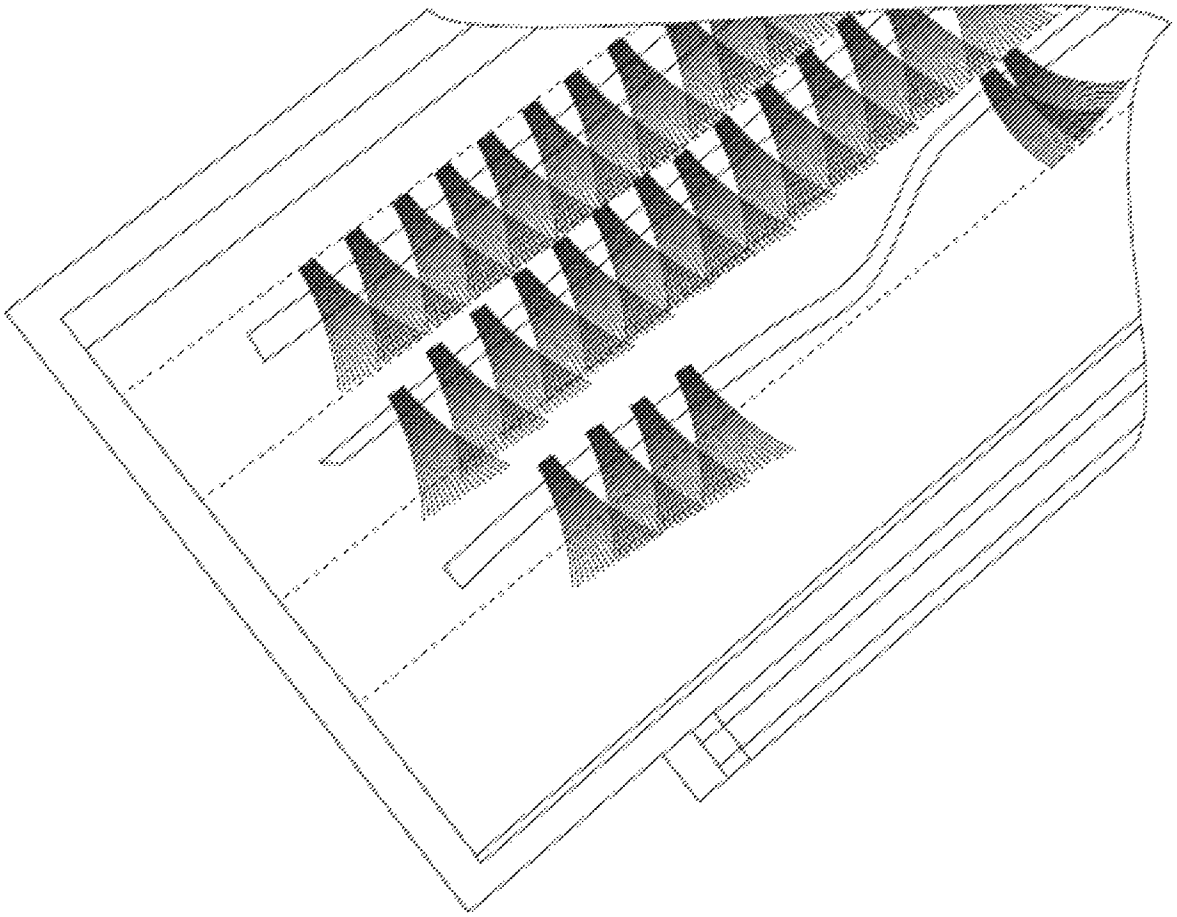
FIG. 2 depicts clusters of artificial lashes that can be used by professional lash technicians and cosmeticians.

FIG. 2 depicts clusters of artificial lashes that can be used by professional lash technicians and cosmeticians. Each cluster of artificial lashes includes multiple artificial hairs that consist of natural materials (e.g., silk or authentic mink hair) or synthetic materials (e.g., acrylic resin, PBT, or synthetic mink hair made of polyester).

Clusters of artificial lashes typically include 10 to 30 artificial hairs that are heated (e.g., as part of a holt melt process) and then secured to one another. For example, in some embodiments linear artificial hairs are heated at one end such that they begin to fuse to one another at that end, while in other embodiments linear artificial hairs are heated near a central point and folded underneath one another.

In some embodiments, some or all of the artificial hairs in a cluster may be tied to a support thread (i.e., knotted). The artificial hairs may be tied by any such means, such as a slip know that prevents horizontal spreading of the cluster.

Figure 3A:
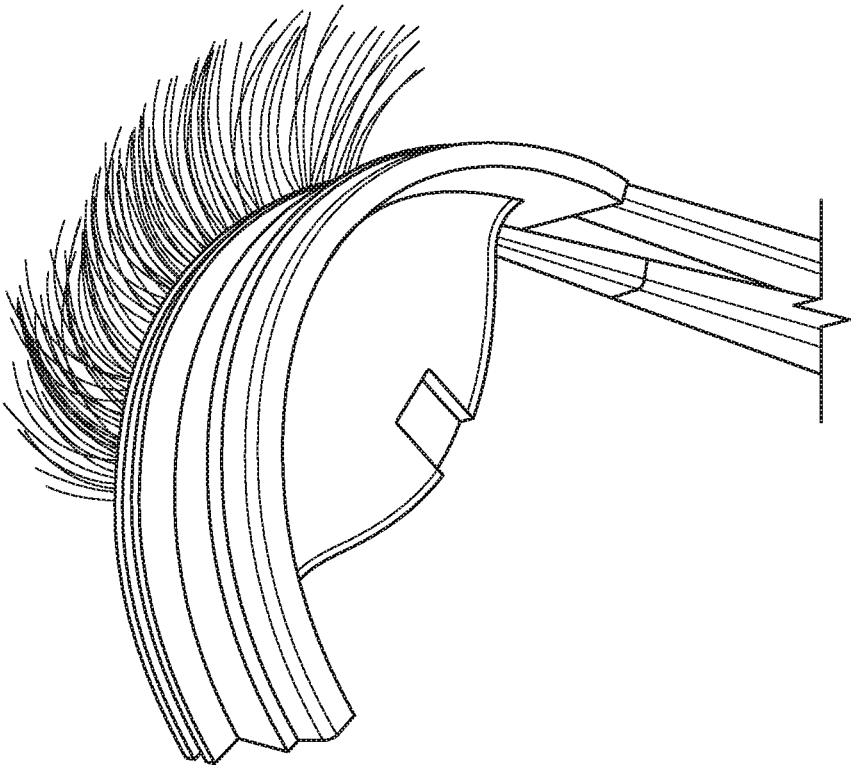
FIGS. 3A-B depict how a set of artificial lash extensions can be affixed beneath the individual's natural lashes.
Figure 3B:
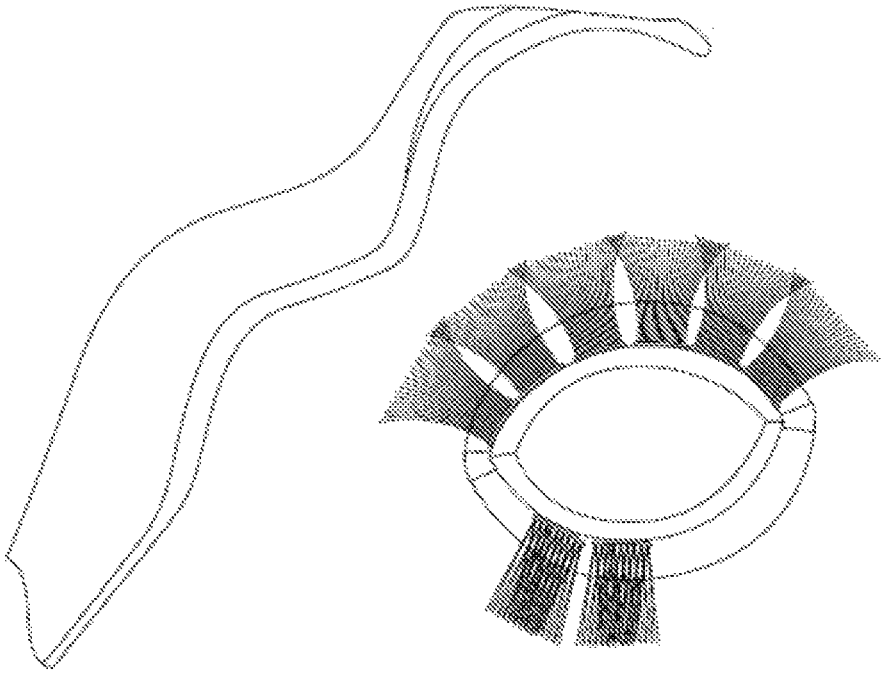

FIGS. 3A-B depict how a set of artificial lash extensions can be affixed to the underside of an individual's natural lashes. More specifically, FIG. 3A is a perspective view of a set of artificial lash extensions from above, while FIG. 2B is a view of the set of artificial lash extensions from below.

A set of artificial lash extensions can include multiple lash fusions that are arranged to match the curvature of the upper tightline of an eyelid. For example, multiple lash fusions may be arranged such that the inner ends (i.e., the bases) form a concave shape that substantially complements the universal tightline of nearly any human eye. In some embodiments, sets of artificial lash extensions preferably include 5-7 distinct clusters of artificial lashes. The number of lash fusions in each set (as well as the number of clusters in each lash fusion) may be based on the thickness of the artificial hair used, the desired style of the eyelid on which the set is intended to be affixed, the desired lash density (also referred to as the "fullness" of the individual's lashes), etc. As shown in FIG. 3B, the set of artificial lash extensions is aligned with the tightline rather than the lash line, and then affixed to the underside of the natural lashes. Said another way, the set of artificial lash extensions is applied directly to the underside of the natural lashes rather than to the eyelid.

An adhesive can be applied to the top of each lash fusion in the set of artificial lash extensions, which enables an individual to easily apply the entire set directly to the natural lashes. The individual responsible for applying the set of artificial lash extensions could be a person who affixes the multiple lash fusions to herself or some other person (e.g., a professional lash technician or a cosmetician). In some embodiments, the adhesive is applied when each lash fusion and/or the set of artificial lash extensions are initially manufactured. Additionally or alternatively, the individual could apply an adhesive before attaching the set of artificial lash extensions to the natural lashes.

The adhesive could be a waterproof (semi-permanent) glue, mascara, or some other copolymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include:

- Acrylates/ethylhexyl acrylate copolymer, aqua, propylene glycol, ceteareth-25, hydrogenated castor oil, glycerin, phenoxyethanol, 2-bromo-2-nitropropane-1, 3-diol, methylcholoroisothiazolinone, methylisothiazolinone, methylparaben, and optionally a color agent (e.g., black 2 (CI 77266));
- Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT));
- Chlorine dioxide, p-anisic acid, biotin, lavandula angustifolio oil, propylene glycol, water, 2-ethylhexyl acrylate, and optionally a preservative (e.g., benzalkonium chloride); and
- Acrylate copolymer and water.

Those skilled in the art will recognize that many other adhesive compositions are possible and, in fact, may be desirable for individuals having certain allergies, desiring certain fixation duration (also referred to as "permanency" of the lash extensions), etc.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

Figure 4A:
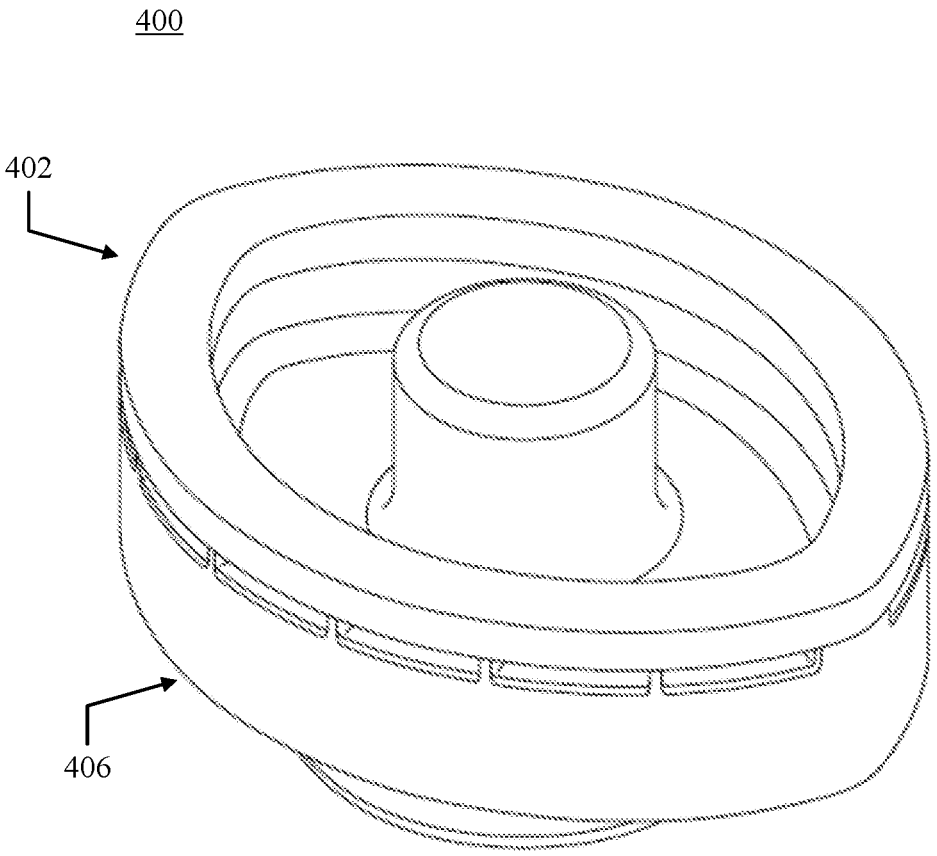
FIGS. 4A-C depict several different views of a case for holding a set of artificial lash extensions.
Figure 4B:
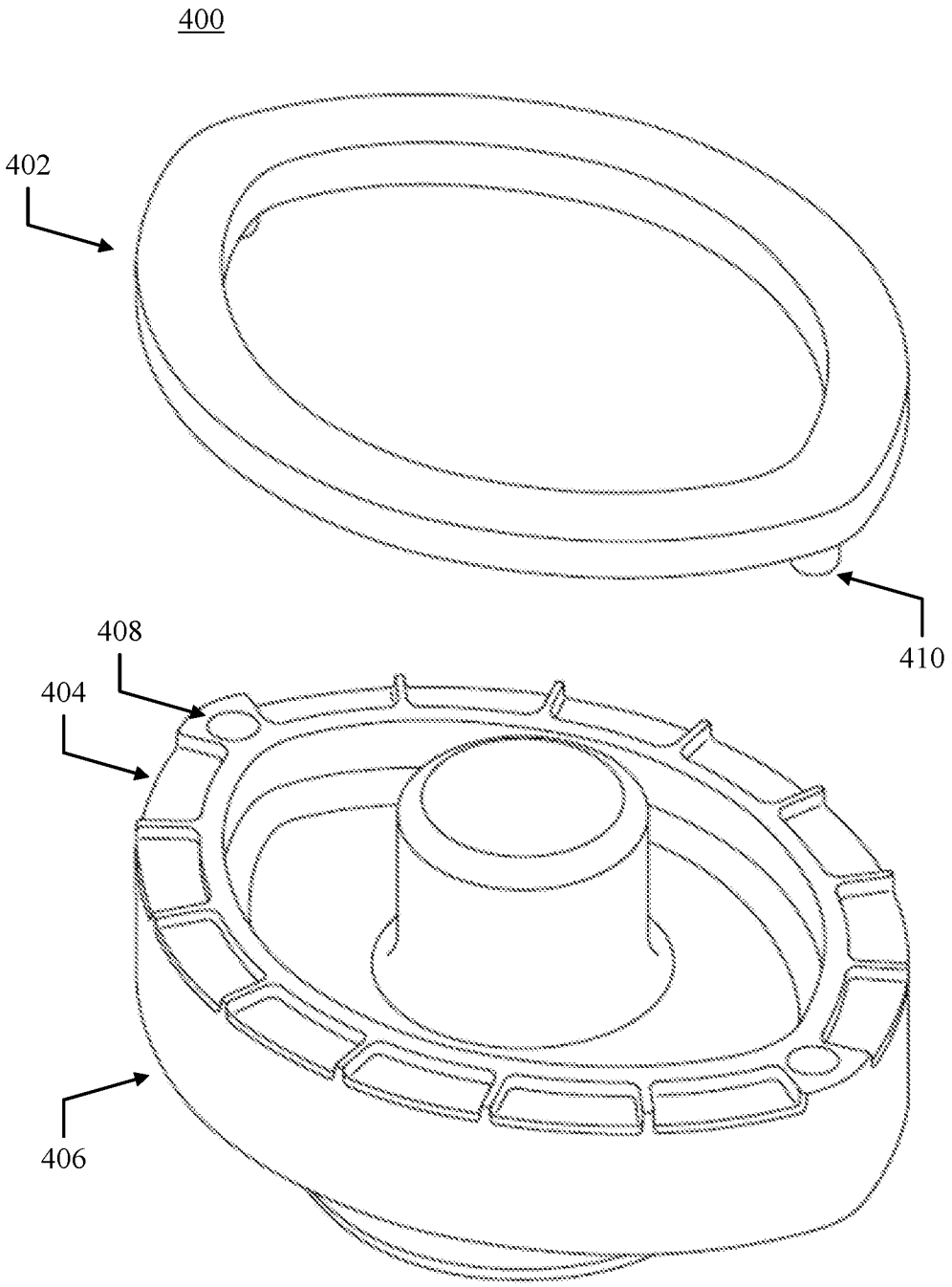
Figure 4C:
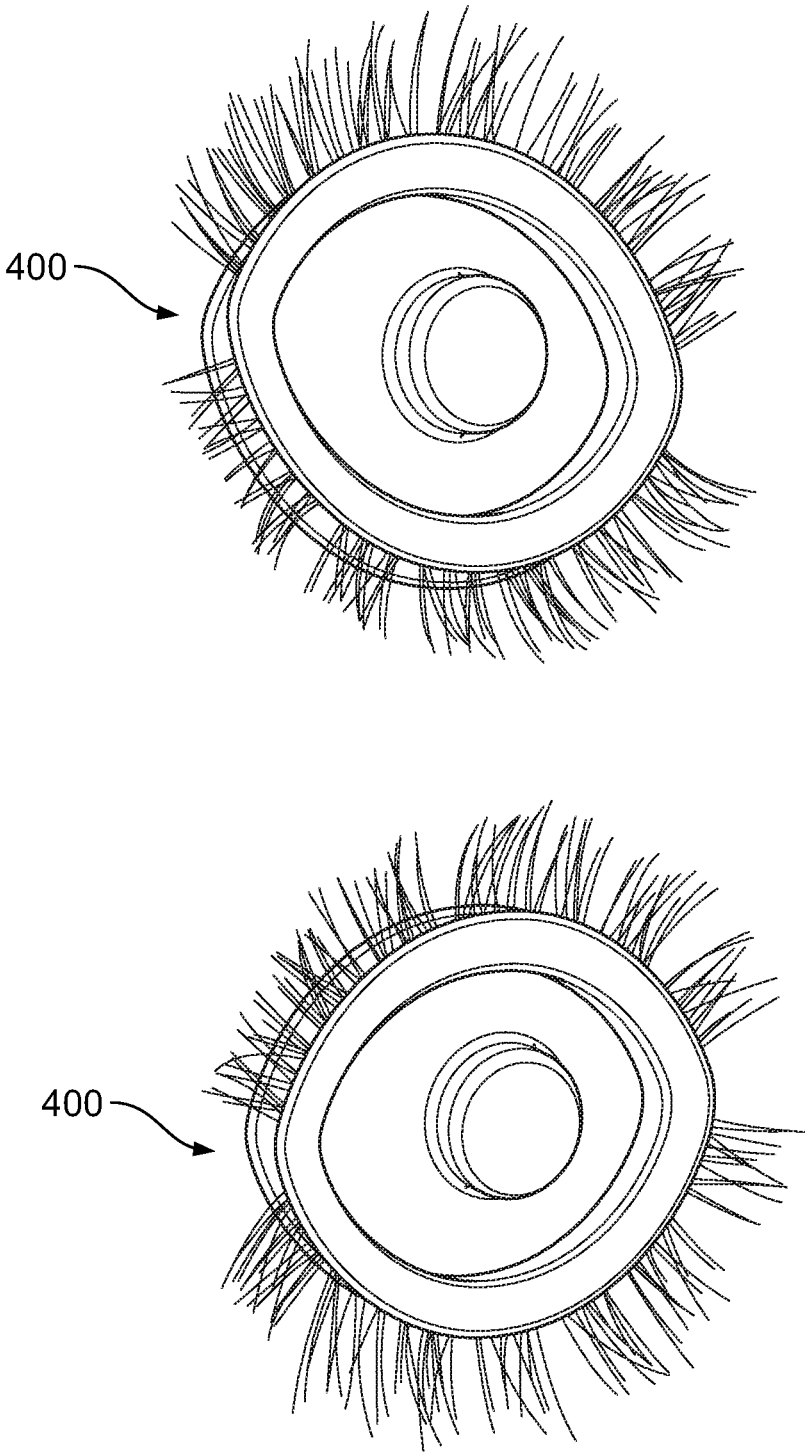

FIGS. 4A-C depict several different views of a case 400 for holding artificial lash extensions. FIG. 4A is a perspective view of the case 400, while FIG. 4B is an exploded view of the case 400 in which the upper cover 402 has been removed to expose multiple predefined indentations 404 within a base assembly 406.

The case 400 may include a base assembly 406 and an upper cover 402 that partially or entirely shields the predefined indentations 404. In some embodiments, the base assembly 406 includes one or more fastener holes 408 that allow fasteners to be used to attach the upper cover 402 to the base assembly 406. One example of a fastener is a fastener boss 410. Other embodiments may provide other means of attachment, such as hidden snaps, latches, detents, ridges, magnets, etc.

The base assembly 406 and/or the upper cover 402 may be partially or entirely composed of metal, plastic, or some other material (e.g., foam). For example, in some embodiments the base assembly 406 includes a die case metal body (e.g., for strength and durability) having a smooth powder coating (e.g., for aesthetics and improved cleanability), while in other embodiments the base assembly 406 includes a recyclable (i.e., disposable) plastic body that is not intended for significant durations of use (e.g., months or years). Those skilled in the art will recognize that any suitable material may be used. For example, in some embodiments plastic may be desirable because it is recyclable and resistant to the adhesives typically applied to lash fusions before fixation to an individual's natural lashes.

Moreover, the outer surfaces of the base assembly 406 and/or the upper cover 402 may be substantially smooth and continuous. Thus, the outer surfaces of these components may be substantially free of any gaps, ridges, or fasteners that would make cleaning difficult or that may inadvertently capture artificial lashes.

FIG. 4C illustrates how multiple lash fusions in a set of artificial lash extensions can be positioned within the case 400 in a specified arrangement. While the multiple lash fusions in the set of artificial lash extensions will typically not be connected to one another, the multiple lash fusions can be arranged such that the set as a whole substantially complements the shape of an eyelid. More specifically, the curvature of the multiple lash fusions may substantially match the tightline curvature of an average person. Thus, an entire set of artificial lash extensions may become substantially flush with the lash line when the set is arranged proximate to the tightline.

The predefined indentations 404 allow the lash fusions to be positioned in a specific arrangement. For example, the curvature of the outer surface of the case 400 may cause the lash fusions to be arranged in the shape of an eyelid (i.e., the outer surface of the case 400 may mimic the natural lash line). Together, the multiple lash fusions form a set of artificial lash extensions that can be collectively applied in a single motion.

Figure 5A:
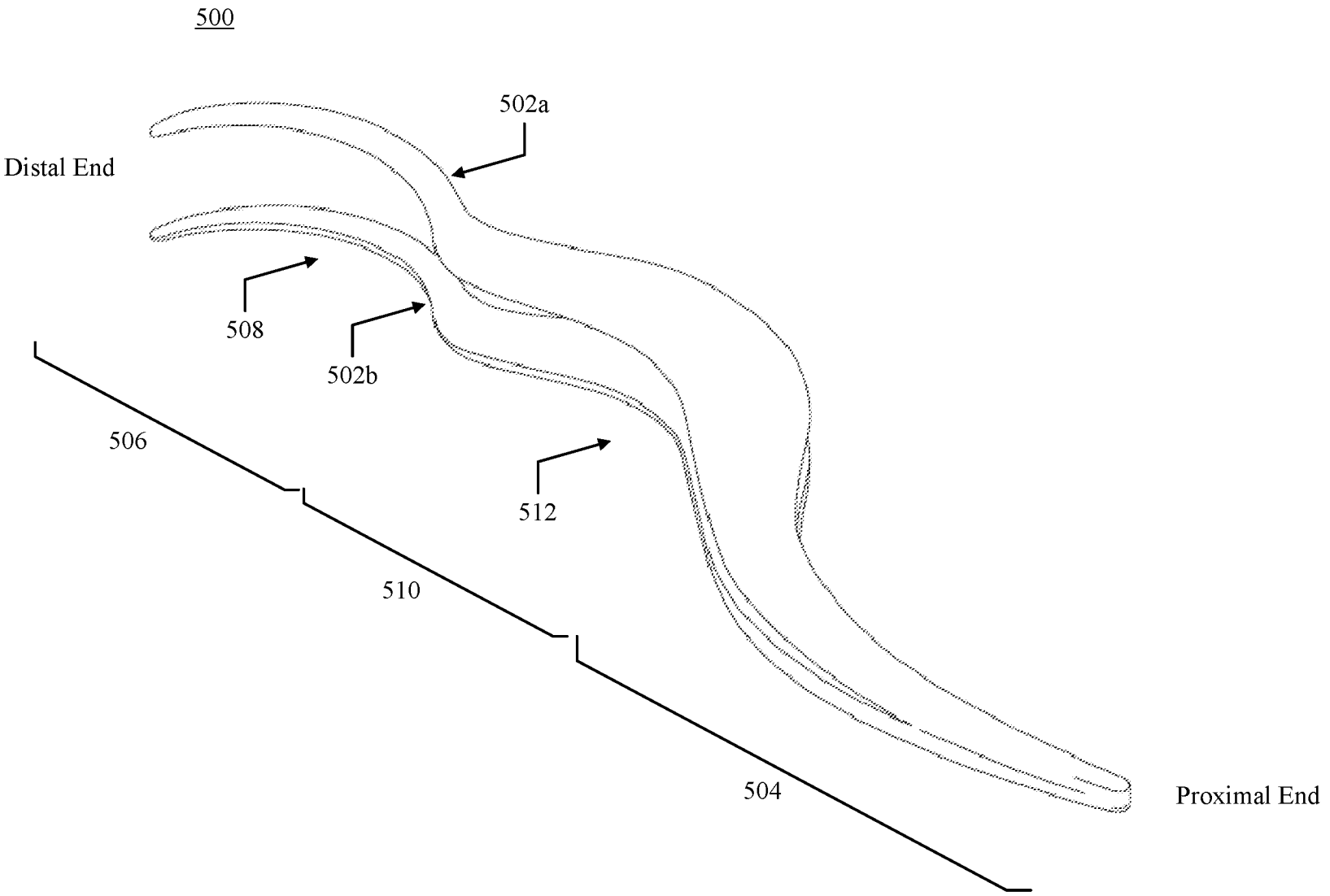
FIGS. 5A-B depict an applicator that can be used to simultaneously apply an entire set of artificial lash extensions to an individual's natural lashes.
Figure 5B:
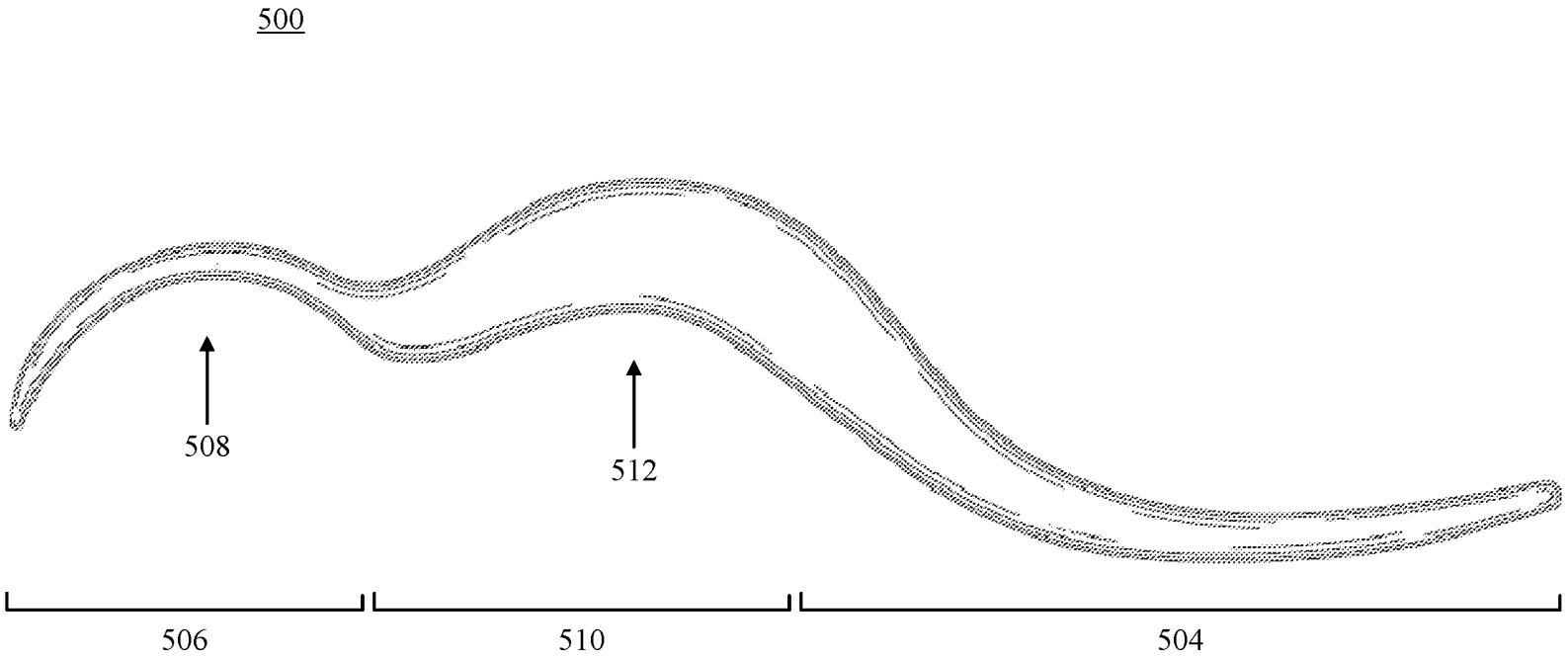

FIGS. 5A-B depict an applicator 500 that can be used to simultaneously apply an entire set of artificial lash extensions to an individual's natural lashes. FIG. 5A is a perspective view of an applicator 500 having two opposed arms, and FIG. 5B is a side view depicting the curvature of the applicator 500.

The applicator 500 includes opposed arms 502*a-b* that are connected to one another at an inner end (also referred to as a "proximal end"). Each of the opposed arms 502*a-b* can include an inner portion 504 that is gripped by an individual and an outer portion 506 that is contoured to resiliently grasp multiple lash fusions. For example, the outer portion 506 may have a concave (e.g., crescent) shape 508 that enables the applicator 500 to become substantially flush with the housing of a case (e.g., case 400 of FIGS. 4A-C) and the tightline of an eye. This non-linear shape enables the individual to readily grasp and apply an entire set of artificial lash extensions without requiring assistance from another individual (e.g., a medical professional or cosmetician).

In some embodiments, the middle portion 510 (also referred to as the "bridge) of the applicator 500 includes another concave shape 512 (also referred to as a "hump") that allows the applicator 500 to rest on the individual's cheek bone, nose bridge, etc. For example, if the individual is holding the applicator 500 in their right hand, then the individual can readily apply a set of artificial lash extensions to the right eye. However, when the individual attempts to apply a set of artificial lash extensions to the left eye, the individual may to balance the hump 512 on the bridge of the nose for stabilization. During the application process, the individual may grasp the inner portion 504 and/or the middle portion 510.

The applicator 500 can be composed of metal, plastic, or any other suitable material. Metal alloys (e.g., stainless steel) are typically preferred because they provide greater durability and allow the applicator 500 to have high precision. The term "precision" refers to the size of objects that can be grasped by the applicator 500. Highly precise grasping tools (e.g., tweezers) can grab very small objects. In order to have high precision, the opposed arms 502*a-b* must be precisely aligned and balanced so that an individual can grasp individual artificial lashes.

Figure 6A:
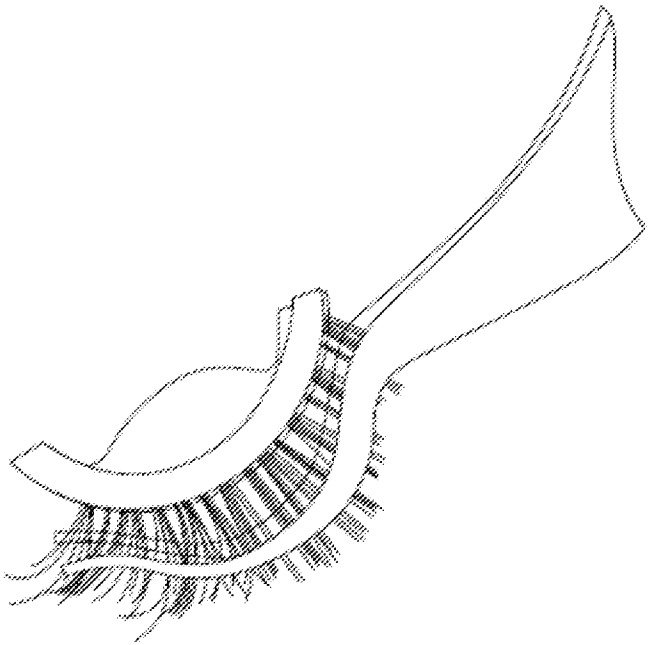
FIGS. 6A-B depict how the concave shape of the outer portions of an applicator enables an individual to simultaneously grasp all of the lash fusions in a set of artificial lash extensions.

The outer portions 506 of the opposed arms 502*a-b* are arranged to engage one another when the inner portions 504 of the opposed arms 502*a-b* are pressed toward one another by an individual. Such action causes pressure to be applied to the exterior surface of the inner portions 504 and/or the middle portions 510 of the opposed arms 502*a-b*. FIG. 6A depicts how the arrangement of a set of artificial lash extensions enables all of the lash fusions to be simultaneously grasped by an applicator. More specifically, an individual or a healthcare professional, such as a lash technician or cosmetician, can grasp an entire set of artificial lash extensions using the applicator, and then simultaneously apply the entire set of artificial lash extensions to the individual's natural lashes in a single motion.

Figure 6B:
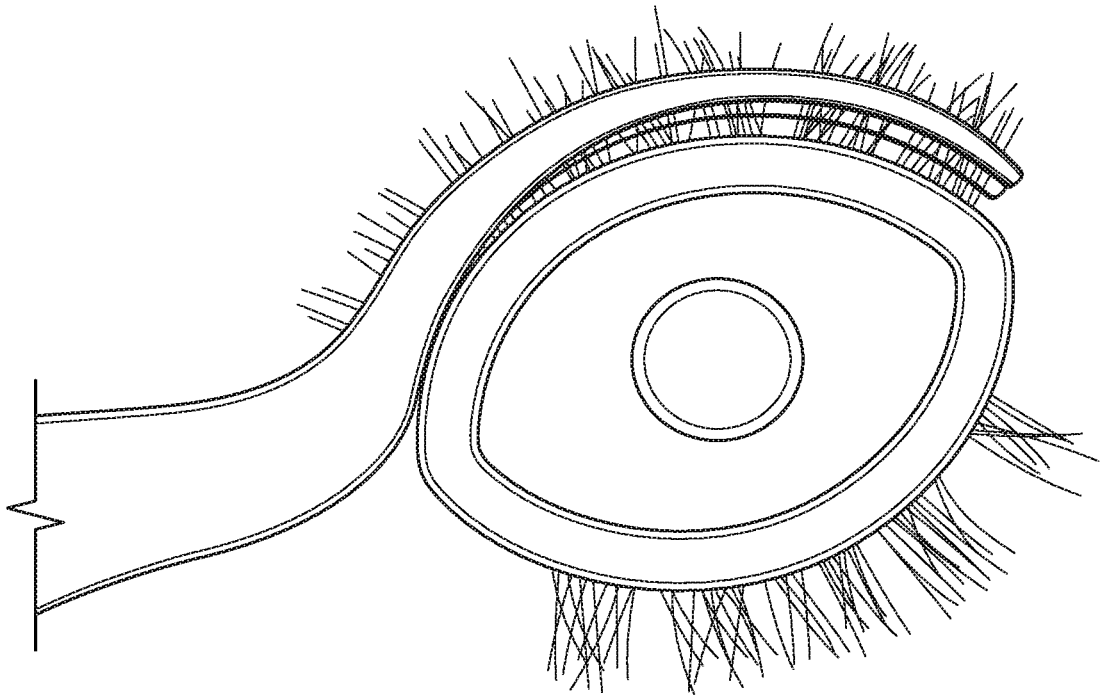

FIG. 6B depicts how the concave shape of an applicator can substantially complement the convex shape of a case. The concave shape of the applicator enables an individual to simultaneously grasp all of the lash fusions in a set of artificial lash extensions housed within the case. After grasping the set of artificial lash extensions, the individual can apply the entire set of artificial lash extensions to the natural lashes in a single motion.

The individual may also exploit the concave shape of the applicator to apply pressure to the multiple lash fusions to ensure that each lash fusion is securely attached to the natural lashes. For example, after applying the set of artificial lash extensions to the underside of the natural lashes, the individual can apply pressure another time to clamp down on the natural lashes and the artificial lash extensions. While the second application of pressure may not be necessarily, the individual may perform such action to ensure adherence of the lash fusions to the natural lashes.

In some embodiments, one or both of the opposed arms include a knurl at the outer end that can be used to aid in grasping. However, the knurl(s) must be offset from one another so that the outer portions of the opposed arms can be pressed against one another. Embodiments may also include a ridge that extends around some or all of the periphery of each opposed arm Although the term "individual" is generally used to refer to a person who applies sets of lash extensions to herself, those skilled in the art will recognize the technology described herein can also be used by healthcare professionals, cosmeticians, etc.

Figure 7:
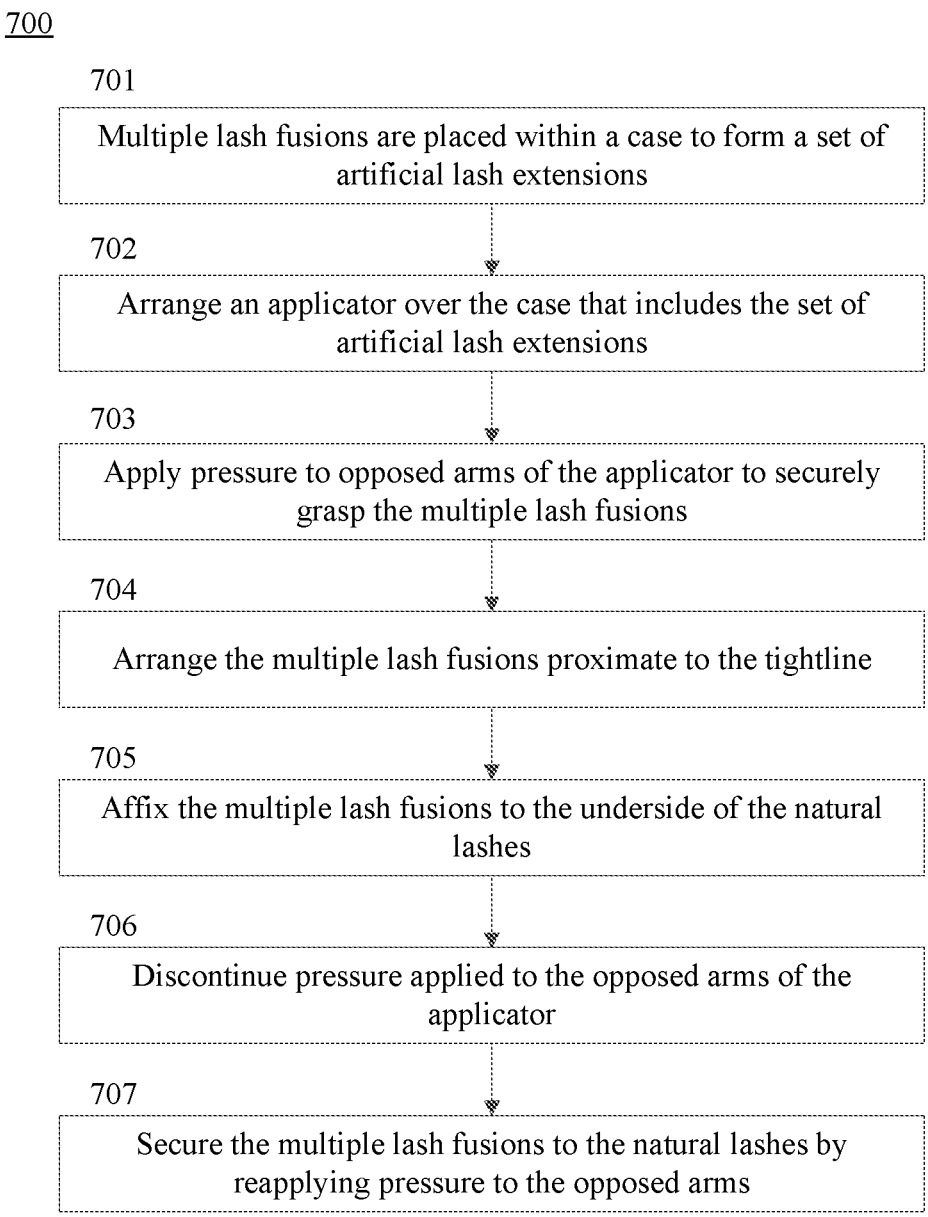
FIG. 7 depicts a flow diagram of a process for applying multiple lash fusions included in a set of artificial lash extensions.

FIG. 7 depicts a flow diagram of a process 700 for applying a set of artificial lash extensions to an individual's natural lashes. Multiple lash fusions are initially placed within a case to form a set of artificial lash extensions (step 701). As noted above, the multiple fusions may be positioned in a specific arrangement. For example, the case may include predefined indentations that cause the multiple lash fusions to be arranged in a convex pattern similar to the shape of an eyelid.

The individual can then arrange an applicator over the case that includes the set of artificial lash extensions (step 702). The applicator includes opposed arms having concave outer portions that substantially complement the convex pattern of lash fusions included in the set, as well as the convex outer surface of the case. The individual can then apply pressure to the opposed arms of the applicator to securely grasp the multiple lash fusions (step 703). Application of such pressure causes the outer portions of the opposed arms to engage one another and grasp each lash fusion included in the set.

The individual arranges the multiple lash fusions proximate to the tightline (step 704), and then attaches the multiple lash fusions to the natural lashes (step 705) by pressing the multiple lash fusions upward against the bottom of the natural eyelashes. Thus, the set of lash fusions may become substantially flush with the lash line. The initial application process can then be completed by discontinuing the pressure applied to the opposed arms of the applicator (step 706). In some embodiments, the individual may further secure the multiple lash fusions to the natural lashes by once again applying pressure to the opposed arms of the application (step 707), which causes the outer portions of the opposed arms to clamp down on the multiple lash fusions and the natural lashes.

Unless contrary to physical possibility, it is envisioned that the steps described above may be performed in various sequences and combinations. For instance, the case may already include the multiple lash fusions before corning into the possession of the individual (thus rendering step 701 unnecessary in some embodiments).

Other steps could also be included in some embodiments. For example, an adhesive may be applied to the top of each lash fusion in the set of artificial lash extensions. In other embodiments, ad adhesive is applied to the top of each lash fusion in the set of artificial lash extensions during the manufacturing process. The adhesive could be a waterproof glue or mascara. For example, the adhesive may include an oil-soluble polymer that helps to enhance adhesion and substantivity of the artificial lash extensions to the individual's natural lashes. The adhesive may be a waterproof formulation that allows the set of artificial lash extensions to remain affixed to the individual's natural lashes for longer periods of time.

Although latex-based adhesives are generally avoided to avoid irritation of the individual's eyelid (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

Figure 8:
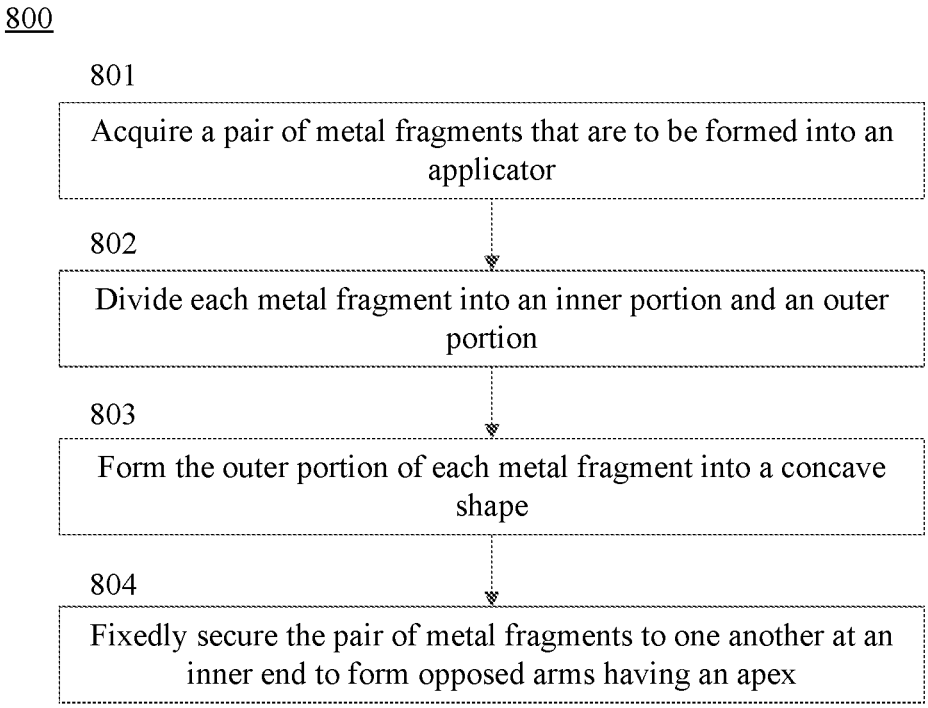
FIG. 8 depicts a flow diagram for a process for manufacturing applicators for applying artificial lash extensions.

FIG. 8 depicts a flow diagram for a process 800 for manufacturing applicators for applying artificial lash extensions. A pair of metal fragments are initially acquired that are to be formed into an applicator for applying artificial lash extensions (step 801). Generally, the metal fragments is comprised of a metal for improved durability, cleanability, etc. Examples of metals include titanium, hardened steel, stainless steel, etc.

Other materials may also be used to form the applicator. For example, the pair of fragments may be comprised of plastic, glass, foam, etc. Moreover, the applicator may be formed from a single piece of material rather than a pair of separate fragments. In such embodiments, the single piece of material can be formed into a v-shaped body having opposed arms and an apex (e.g., through the application of heat to a central point at which the single piece of material is folded).

Each metal fragment can be logically divided into an inner portion designed to be gripped by an individual and an outer portion designed to grasp a set of artificial lash extensions (step 802). For example, the outer portion of each metal fragment may be wide enough to simultaneously grasp 4-8 clusters of artificial lashes. In some embodiments, the metal fragments may be slightly thinner at the proximal end (also referred to as the "gripping end") in order to provide greater flexibility.

The outer portion of each metal fragment is then formed into a concave shape that may substantially match the tightline curvature of an eyelid (step 803). Said another way, the outer portion of each metal fragment may be contoured to match the curvature of the tightline of an eyelid. This can be accomplished, for example, using appropriately shaped die blocks and machine molding. Such a design enables an individual to simultaneously grasp and apply multiple lash fusions without requiring assistance from another individual (e.g., a medical professional or cosmetician).

In some embodiments, a middle portion of each metal fragment is also formed into a concave shape that allows the applicator to rest on the cheek bone, nose bridge, etc. For example, if an individual is holding the applicator in their right hand, then the individual can readily apply a set of artificial lash extensions to the right eye. However, when the individual attempts to apply a set of artificial lash extensions to the left eye, the individual may to balance the middle portion on the bridge of the nose for stabilization.

The pair of metal fragments can then be fixedly secured to one another at the proximal end to form opposed arms having an apex (step 804). For example, an individual may use an induction welder to fuse the pair of metal fragments together at the proximal end. This arrangement of the opposed arms allows an individual to securely grasp lash fusion(s) by applying pressure to the opposed arms. Forming the applicator in such a manner also ensures that the opposed arms naturally revert or "spring" back to their original position when pressure is no longer being applied by the individual.

In some embodiments, the applicator is treated (e.g., by being powder coated) to improve durability, resistance to scratching, cleanability, resistance to chemicals/solutions, etc. For example, the outer portion of each metal fragment may have a non-stick to avoid stickiness. Examples of non-stick coatings include polytetrafluoroethylene (PTFE) coatings, silicone coatings, etc. Upon being completed, the applicator can be used by an individual to simultaneously grasp and apply a set of artificial lash extensions by applying pressure to the opposed arms.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

What is claimed is:

1. A storage case comprising:

a storage base comprising:

a top portion;

a first outer sidewall having a first curved surface forming an exterior surface of the storage case; and a first plurality of indentations extending inward from the first curved surface of the first outer sidewall and extending vertically towards the top portion of the storage base, wherein each indentation of the first plurality of indentations comprises a substantially flat surface that extends inward from the first curved surface, and wherein the substantially flat surface of each indentation of the first plurality of indentations is designed to seat at least a portion of artificial hairs of an artificial lash extension.

2. The storage case of claim 1, the storage base further comprising:

a second outer sidewall opposite the first outer sidewall, the second outer sidewall having a second curved surface; and a second plurality of indentations extending inward from the second curved surface of the second outer sidewall, wherein each indentation of the second plurality of indentations comprises a substantially flat surface that extends inward from the second curved surface.

3. The storage case of claim 1, wherein each indentation of the first plurality of indentations is designed to receive at least part of the artificial lash extension.

4. The storage case of claim 3, wherein each indentation of the first plurality of indentations is designed to receive at least part of the artificial lash extension such that another part of the artificial lash extension extends outside the storage base.

5. The storage case of claim 2, wherein each indentation of the first plurality of indentations and the second plurality of indentations is designed to receive at least a base of the artificial lash extension and to allow at least some artificial hairs of the artificial lash extension to extend outside the storage base.

6. The storage case of claim 2, wherein the storage case is designed to hold a first plurality of artificial lash extensions at the first plurality of indentations and a second plurality of artificial lash extensions at the second plurality of indentations.

7. The storage case of claim 2, wherein the storage base further comprises:

a first plurality of partitions of the first outer sidewall, the first plurality of partitions positioned between adjacent indentations of the first plurality of indentations; and a second plurality of partitions of the second outer sidewall, the second plurality of partitions positioned between adjacent indentations of the second plurality of indentations.

8. The storage case of claim 7, wherein the first plurality of partitions extend inward from the first curved surface of the storage base, and wherein the second plurality of partitions extend inward from the second curved surface of the storage base.

9. The storage case of claim 7, wherein the first plurality of indentations are arranged adjacent to one another along the top portion of the storage base.

10. The storage case of claim 9, wherein the first plurality of indentations are arranged adjacent to one another along a top surface of the top portion of the storage base.

11. The storage case of claim 6, further comprising:

a cover configured to releasably couple to the storage base.

12. The storage case of claim 11, wherein the cover further comprises:

one or more fasteners configured to releasably couple the cover to the storage base.

13. The storage case of claim 11, wherein the cover that is coupled to the storage base is configured to cover at least part of one or more of the first plurality of indentations or the second plurality of indentations.

14. The storage case of claim 11, wherein at least part of one or more of the first plurality of indentations or the second plurality of indentations are exposed based on a removal of the cover from the storage base.

15. The storage case of claim 11, wherein the cover coupled to the storage base is designed to releasably hold any artificial lash extension of the first plurality of artificial lash extensions or the second plurality of artificial lash extensions.

16. The storage case of claim 15, wherein at least one of the cover or the storage base comprise a plastic material.

17. A system comprising:

a storage case comprising:

a storage base comprising:

a top portion;

a first outer sidewall having a first curved surface forming an exterior surface of the storage case; and a first plurality of indentations extending inward from the first curved surface of the first outer sidewall and extending vertically towards the top portion of the storage base, wherein each indentation of the first plurality of indentations comprises a substantially flat surface that extends inward from the first curved surface; and one or more artificial lash extensions, wherein the substantially flat surface of each indentation of the first plurality of indentations is designed to seat at least a portion of artificial hairs of an artificial lash extension of the one or more artificial lash extensions.

18. The system of claim 17, wherein each of the one or more artificial lash extensions comprises:

a plurality of clusters of artificial hairs, each of the plurality of clusters of artificial hairs comprising multiple artificial hairs; and a base to which each of the plurality of clusters of artificial hairs are attached.

19. The system of claim 17, further comprising:

an applicator for applying the one or more artificial lash extensions to an underside of a natural lash, the applicator comprising:

a pair of opposing arms that are joined to each other at one end of each arm to form a hinge, each arm comprising an applicator section defining a curvature that is contoured to align substantially flush with a shape of a tightline.

20. The system of claim 17, the storage case further comprising:

a cover configured to releasably couple to the storage base.

* * * * *